US009808683B2

(12) United States Patent
Oldknow et al.

(10) Patent No.: US 9,808,683 B2
(45) Date of Patent: Nov. 7, 2017

(54) IRON-TYPE GOLF CLUB HEAD OR OTHER BALL STRIKING DEVICE

(71) Applicant: Karsten Manufacturing Corporation, Phoenix, AZ (US)

(72) Inventors: Andrew G. V. Oldknow, Beaverton, OR (US); Robert M. Boyd, Flower Mound, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/634,271

(22) Filed: Feb. 27, 2015

(65) Prior Publication Data

US 2015/0165282 A1 Jun. 18, 2015

Related U.S. Application Data

(63) Continuation of application No. 13/854,555, filed on Apr. 1, 2013, now Pat. No. 8,979,674, which is a continuation of application No. 12/725,092, filed on Mar. 16, 2010, now Pat. No. 8,409,022.

(51) Int. Cl.
*A63B 53/04* (2015.01)

(52) U.S. Cl.
CPC ..... *A63B 53/047* (2013.01); *A63B 2053/042* (2013.01); *A63B 2053/0416* (2013.01); *A63B 2053/0433* (2013.01); *A63B 2053/0491* (2013.01)

(58) Field of Classification Search
CPC ..... A63B 53/04
See application file for complete search history.

(56) References Cited

U.S. PATENT DOCUMENTS

| | | | | |
|---|---|---|---|---|
| 6,506,129 | B2 | 1/2003 | Chen | |
| 6,852,041 | B1 | 2/2005 | Huang | |
| 7,258,628 | B2 | 8/2007 | Huang et al. | |
| 7,431,665 | B2 | 10/2008 | Sugimoto | |
| 2001/0055996 | A1* | 12/2001 | Iwata | A63B 53/04 473/350 |

(Continued)

FOREIGN PATENT DOCUMENTS

| | | | |
|---|---|---|---|
| CN | 1366463 | A | 8/2002 |
| JP | 2001321473 | | 11/2001 |

(Continued)

OTHER PUBLICATIONS

Sep. 9, 2011—(WO) International Search Report and Written Opinion—App PCT/US2011/026797.

*Primary Examiner* — Michael Dennis

(57) ABSTRACT

A ball striking device, such as an iron-type golf club head, includes a face having a ball striking surface and a rear surface, and a body connected to the face. The body has a sole member and a rear cavity defined at least partially by the sole member and the rear surface of the face. The body has an elongated, recessed channel extending within the cavity along a juncture line between the rear surface of the face and the sole member. Additionally, the head is formed in part by a face member having a first leg forming at least a major portion of the face and a second leg extending rearwardly from a bottom end of the first leg and forming at least a portion of the sole member. The head may further be formed by a body member connected to the face member.

23 Claims, 30 Drawing Sheets

(56) References Cited

U.S. PATENT DOCUMENTS

| | | | | |
|---|---|---|---|---|
| 2005/0009633 | A1 | 1/2005 | Rice et al. | |
| 2006/0052179 | A1 | 3/2006 | Hou | |
| 2006/0229141 | A1 | 10/2006 | Galloway | |
| 2006/0252575 | A1 | 11/2006 | Chen | |
| 2007/0232410 | A1 | 10/2007 | Chu | |
| 2008/0039231 | A1 | 2/2008 | Lin et al. | |
| 2008/0176674 | A1* | 7/2008 | Horacek ..... | A63B 53/0466 473/349 |
| 2009/0069116 | A1 | 3/2009 | Chen | |
| 2009/0305815 | A1 | 12/2009 | Hirano | |

FOREIGN PATENT DOCUMENTS

| | | | |
|---|---|---|---|
| JP | 2004358233 | A | 12/2004 |
| TW | M296063 | | 8/2006 |

* cited by examiner

IRON-TYPE GOLF CLUB HEAD OR OTHER BALL STRIKING DEVICE

CROSS-REFERENCE TO RELATED APPLICATIONS

The present application claims priority to and is a continuation of co-pending U.S. patent application Ser. No. 13/854,555, filed Apr. 1, 2013, which is a continuation of U.S. patent application Ser. No. 12/725,092, filed Mar. 16, 2010, and issued as U.S. Pat. No. 8,409,022 on Apr. 2, 2013, which prior applications are incorporated by reference herein in their entireties and made part hereof.

TECHNICAL FIELD

The invention relates generally to ball striking devices, such as iron-type golf clubs and heads. Certain aspects of this invention relate to iron-type golf clubs having multi-piece heads with a "hot zone" that extends proximate the bottom edge of the face.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well-known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. When the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories. Accordingly, club head features that can help a user keep the club face square with the ball would tend to help the ball fly straighter and truer, in the desired direction, and often with improved and/or reliable distance.

The energy or velocity transferred to the ball by a golf club also may be related, at least in part, to the "coefficient of restitution" (or "COR") of the club face at the point of contact. The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the desired ball contact location, usually at the center of the face. Iron-type golf clubs are often used to hit a ball sitting directly on the playing surface, and thus, frequently impact the ball at locations below the center of the face. Accordingly, an iron-type golf club may benefit from a design where the area of highest COR response (i.e. the "hot zone") of the face extends below the center of the face and closer to the bottom edge of the face.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include an iron-type head that has a face having a ball striking surface defined thereon and a rear surface opposite the ball striking surface, and a body connected to the face. The body has a sole member having a sole surface configured to confront a playing surface, and a rear cavity defined at least partially by the sole member and the rear surface of the face. The body has an elongated, recessed channel extending within the cavity along a juncture line between the rear surface of the face and the sole member. Additionally, the head is formed in part by a face member having a first leg forming at least a major portion of the face and a second leg extending rearwardly from a bottom end of the first leg and forming at least a portion of the sole member.

According to one aspect, the head is further formed in part by a body member connected to the face member by welding or another integral joining technique. The body member includes a top portion welded to the to the top end of the first leg along a first lateral weld line, and a bottom portion welded to a rear end of the second leg along a second lateral weld line. The top portion forms an upper portion of the face and at least a portion of a top side of the body, and the bottom portion forms at least a portion of the sole member. In one embodiment, the body member is formed of a single piece.

According to another aspect, the head is further formed in part by a body member connected to the face member by welding or another integral joining technique. The body member is welded to the top end of the first leg along a lateral weld line to form an upper portion of the face and at least a portion of a top side of the body. In one embodiment, the rear end of the second leg of the face member includes a projection extending rearward from the second leg. The projection forms a portion of the sole surface, such that the weld line between the face member and the body member has a rearward jog formed by the projection. In another embodiment, the body member has an indent cooperatively dimensioned with the projection, and the indent receives the projection when the body member is connected to the face member. In a further embodiment, the second leg of the face member has a width that is narrower than a width of the face member. In yet another embodiment, the body member is connected to the face member by a peripheral weld line extending around edges of the face, and the lateral weld line is continuous with the peripheral weld line. In yet another embodiment, the channel is defined by portions of the rear surface of the face, the second leg of the face member, and the body member.

According to yet another aspect, the face has an area of highest response that is directionally enlarged toward a bottom edge of the face.

According to a further aspect, the head further includes a hosel configured for connection of a shaft thereto. In one embodiment, the hosel and the face member are integrally formed of a single piece. In another embodiment, the hosel and the body member are integrally formed of a single piece.

Additional aspects of the invention relate to an iron-type golf club head that includes a face having a ball striking surface and a body connected to the face. The body includes a sole member having a sole surface configured to confront the playing surface. The head is formed by a plurality of members or pieces, including a face member and a body member connected by welding or another integral joining technique. The face member includes a first upwardly-extending leg having a top end and a bottom end and a second leg having a front end connected to the bottom end of the first leg and a rear end located rearwardly from the front end, such that the second leg extends rearwardly from the bottom end of the first leg. The first leg forms a face of the head, and the second leg forms a portion of the sole member of the body. The body member is connected to the face member by a peripheral weld line that extends around a periphery of the face and across the sole to connect the face member to the body member.

According to one aspect, the body includes a peripheral wall extending rearward from the outer edges of the face around the periphery of the face. The peripheral wall is formed by portions of the face member and the body member, such that the peripheral weld line extends along the peripheral wall. In one embodiment, the peripheral weld line includes a first vertical weld line extending along a heel side of the peripheral wall, a second vertical weld line extending along a toe side of the peripheral wall, a first lateral weld line extending along a top side of the peripheral wall, and a second lateral weld line extending along a sole side of the peripheral wall. In another embodiment, the first vertical weld line, the second vertical weld line, the first lateral weld line, and the second lateral weld line combine to form the peripheral weld line in a continuous manner.

According to another aspect, the body member is connected to the rear end of the second leg of the face member by the peripheral weld line, such that the body member forms at least a portion of the sole member.

According to yet another aspect, the body member is connected to the top end of the first leg of the face member by the peripheral weld line, such that the body member forms at least a portion of a top side of the head.

According to a further aspect, the body member is connected to the top end of the first leg of the face member and the rear end of the second leg of the face member by the peripheral weld line, such that the body member forms at least a portion of the sole member and at least a portion of a top side of the head.

According to a still further aspect, the rear end of the second leg of the face member comprises a rearwardly extending projection, and the body member has an indent that receives the projection therein. The peripheral weld line extends around a juncture between the indent and the projection, forming a jog in the peripheral weld line.

According to an additional aspect, the face has a rear surface opposite the ball-striking surface, and the body further comprises a rear cavity defined between the sole member and the rear surface of the face and an elongated, recessed channel extending within the cavity along a juncture line between the rear surface of the face and the sole member.

Further aspects of the invention relate to an iron-type golf club head that includes a face having a ball striking surface and a body connected to the face. The body has a sole member having a sole surface configured to confront the playing surface. The head is formed by a plurality of members or pieces, including a face member and a body member connected by welding or another integral joining technique. The face member includes a first upwardly-extending leg having a top end and a bottom end and a second leg having a front end connected to the bottom end of the first leg and a rear end located rearwardly from the front end, such that the second leg extends rearwardly from the bottom end of the first leg. The first leg forms a major portion of a face of the head, and the second leg forms a portion of a sole of the body. The body member is connected to the face member and includes a top portion welded to the to the top end of the first leg along a first lateral weld line and a bottom portion welded to the rear end of the second leg along a second lateral weld line. The top portion of the body member forms an upper portion of the face and at least a portion of a top side of the body, and the bottom portion of the body member forms at least a portion of the sole member.

According to one aspect, the body member is further connected to the face member by a peripheral weld line that extends around a periphery of the face from the first lateral weld line to the second lateral weld line. In one embodiment, the peripheral weld line includes a first vertical weld line extending from a first end of the first lateral weld line to a first end of the second lateral weld line and a second vertical weld line extending from a second end of the first lateral weld line to a second end of the second lateral weld line. In another embodiment, the body includes a peripheral wall extending rearward from outer edges of the face around the periphery of the face. The peripheral wall is formed by portions of the face member and the body member, such that the peripheral weld line extends along a portion of the peripheral wall.

According to another aspect, the face member is substantially L-shaped in cross-section.

Other aspects of the invention relate to golf clubs that include a golf club head as described above and a shaft connected to the head, or a set of such golf clubs.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
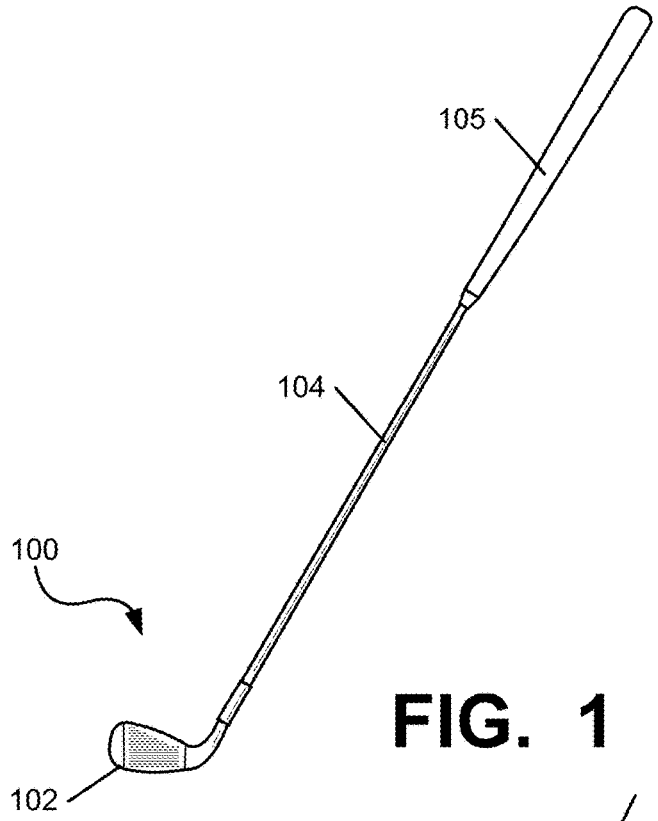
FIG. 1 is a front view of an illustrative embodiment of an iron-type ball striking device according to aspects of the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage thereto.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to iron-type golf clubs and golf club heads, including long irons, short irons, wedges, etc. Alternately, some aspects of this invention may be practiced with hybrid clubs, chippers, and the like, or wood-type golf clubs and the like.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, as well as long iron clubs (e.g., driving irons, zero irons through five irons), short iron clubs (e.g., six irons through pitching wedges, as well as sand wedges, lob wedges, gap wedges, and/or other wedges), hybrid clubs, and putters. Such devices may include a one-piece construction or a multiple-piece construction. Example structures of ball striking devices according to this invention will be described in detail below in conjunction with FIG. 1, which illustrates an example of a ball striking device 100 in the form of an iron-type golf club, in accordance with at least some examples of this invention.

FIG. 1 illustrates a ball striking device 100 in the form of a golf iron, in accordance with at least some examples of this invention, and illustrative embodiments of heads 102, et seq., of ball striking devices 100 of this type are shown in FIGS. 2-31. The golf club head 102 of FIG. 1 may be representative of any iron-type golf club head in accordance with examples of the present invention. As shown in FIG. 1, the ball striking device 100 includes a ball striking head 102 and a shaft 104 connected to the ball striking head 102 and extending therefrom. The ball striking head 102 of the ball striking device 100 of FIG. 1 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

As shown in FIGS. 2-7, the golf club head 102 includes a body member 108 having a face 112 and a hosel 109 extending from the body 108 for attachment of the shaft 104. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. The heel portion 120 is attached to and/or extends from the hosel 109 (e.g., as a unitary or integral one piece construction, as separate connected elements, etc.). In the embodiment shown in FIGS. 2-7, the body 108 and the hosel 109 are formed as a single, integral piece, such as by casting, forging, etc. The face 112 may also be formed of the same single, integral piece with the body 108 and the hosel 109. In another embodiment, the face 112, the body 108, and/or the hosel 109 may be formed of two or more separate pieces that are connected together by an integral joining technique or another joining technique. In other applications, such as for a different type of golf club, the head may be designed to have different dimensions and configurations.

The face 112 is located at the front 124 of the head 102, and has a ball striking surface 110 located thereon. The head 102 has a rear surface 111 located opposite the ball striking surface 110, which may be considered an inner surface of the face 112. The face 112 is defined by a plurality of peripheral edges, including a top edge 113, a bottom edge 115, a heel edge 117, and a toe edge 119. Additionally, the face 112 may be recognized as a portion of the head 102 that is intentionally smoothed and/or flattened to be configured for striking the ball, and the edges 113, 115, 117, 119 may be recognized as the borders or boundaries of this intentionally smoothed and/or flattened area.

The ball striking surface 110 is typically an outer surface of the face 112 configured to face a ball (not shown) in use, and is adapted to strike the ball when the device 100 is set in motion, such as by swinging. As shown, the ball striking surface 110 is relatively flat, occupying most of the face 112. The ball striking surface 110 may include grooves 121 (e.g., generally horizontal grooves 121 extending across the face 112 in the illustrated example) for the removal of water and grass from the face 112 during a ball strike. Of course, any number of grooves, desired groove patterns, and/or groove constructions may be provided (or even no groove pattern, if desired), including conventional groove patterns and/or constructions, without departing from this invention.

For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the ball striking surface 110 may occupy a different proportion of the face 112, or the body 108 may have multiple ball striking surfaces 110 thereon. As seen in the illustrative embodiments in FIGS. 5-7, the ball striking surface 110 is inclined (i.e., at a loft angle), to give the ball an appreciable degree of lift and spin when struck. In other illustrative embodiments, the ball striking surface 110 may have a different incline or loft angle, to affect the trajectory of the ball. Additionally, the face 112 may have a variable thickness and/or may have one or more internal or external inserts in some embodiments. It is understood that the face 112, the body 108, and/or the hosel 109 can be formed as a single piece or as separate pieces that are joined together.

The body member 108 of the golf club head 102 may be constructed from a wide variety of different materials, including materials conventionally known and used in the art, such as steel, titanium, aluminum, tungsten, graphite, polymers, or composites, or combinations thereof. Also, if desired, the club head 102 may be made from any number of pieces (e.g., having a separate face plate, etc.) and/or by any construction technique, including, for example, casting, forging, welding, and/or other methods known and used in the art.

The ball striking device 100 may include a shaft 104 connected to or otherwise engaged with the ball striking head 102, as shown schematically in FIG. 1. The shaft 104 is adapted to be gripped by a user to swing the ball striking device 100 to strike the ball. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

In one exemplary embodiment, shown in FIGS. 2-7, the body 108 of the head 102 includes a rear cavity 130 located behind the face 112, which is defined at least partially by the rear surface 111. As shown in FIGS. 3-7, the body 108 further includes a sole body member 131 extending rearward from the bottom edge 115 of the face 112, and the rear cavity 130 is also partially defined by a rear wall 132 extending upward from the rear of the sole member 131. The rear cavity 130 may also be partially defined by peripheral or perimeter walls 133 extending rearward from the peripheral edges of the face 112, including the top edge 113, the heel edge 117, and the toe edge 119 of the face 112. It is understood that the sole member 131, or a portion thereof, may be considered to be a peripheral wall 133 as defined herein. The peripheral walls 133 follow the curvilinear contour of the body 108, and form a semi-circular opening to the rear cavity 130 defined by the peripheral walls 133 and the top edge of the rear wall 132. In this embodiment, the sole member 131 forms at least part of the sole 118 of the head 102, and the mass of the sole member 131 lowers the center of gravity of the head 102, which in turn, can produce greater loft on balls hit on the face 112. Additionally, the sole member 131 has an inner surface 134 that in part defines the rear cavity 130 and an outer surface 135 that forms at least a portion of a sole surface on the sole 118 of the head 102. In another embodiment, the rear wall 132 may extend a greater or smaller height from the sole member 131, and may completely enclose the rear cavity 130 in one embodiment. In additional embodiments, such as the embodiments illustrated in FIGS. 8-31, the head 102 may have a differently configured sole member and/or rear wall, or may not contain all of these components. For example, in the embodiment shown in FIGS. 17-21, the head 402 has no rear wall extending upward from the sole member 431. In a further embodiment, the head 102 may contain no rear cavity 130, such as a traditional blade-type iron club head configuration, and some or all of the features of the invention described herein can be used in connection with such a blade-type club head.

Figure 2:
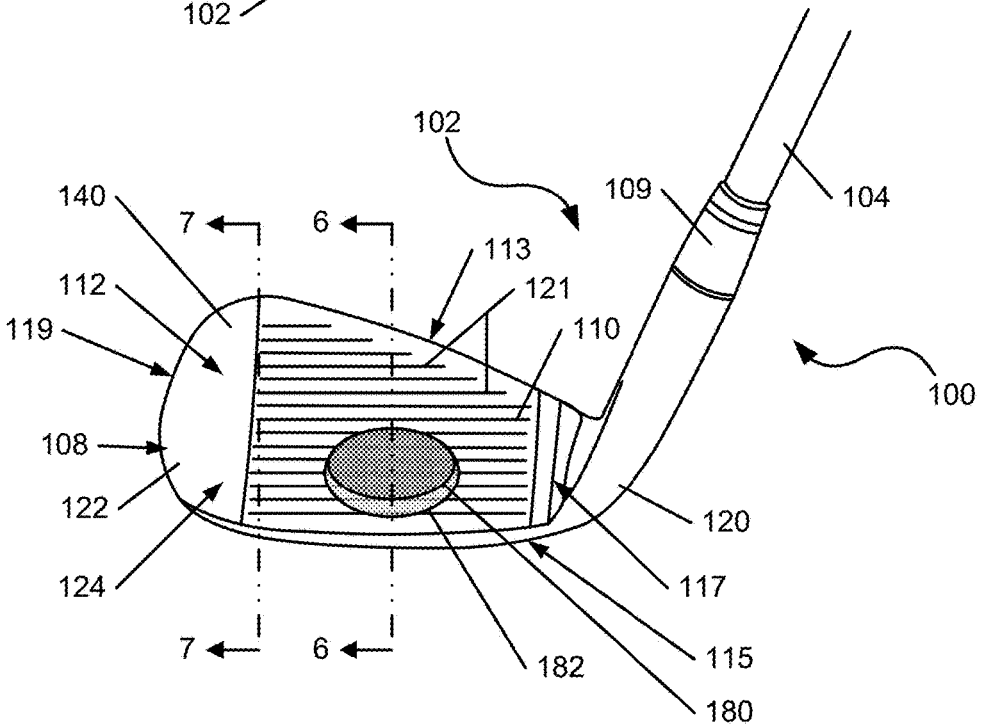
FIG. 2 is a front view of an illustrative embodiment of a head of the ball striking device of FIG. 1.
Figure 3:
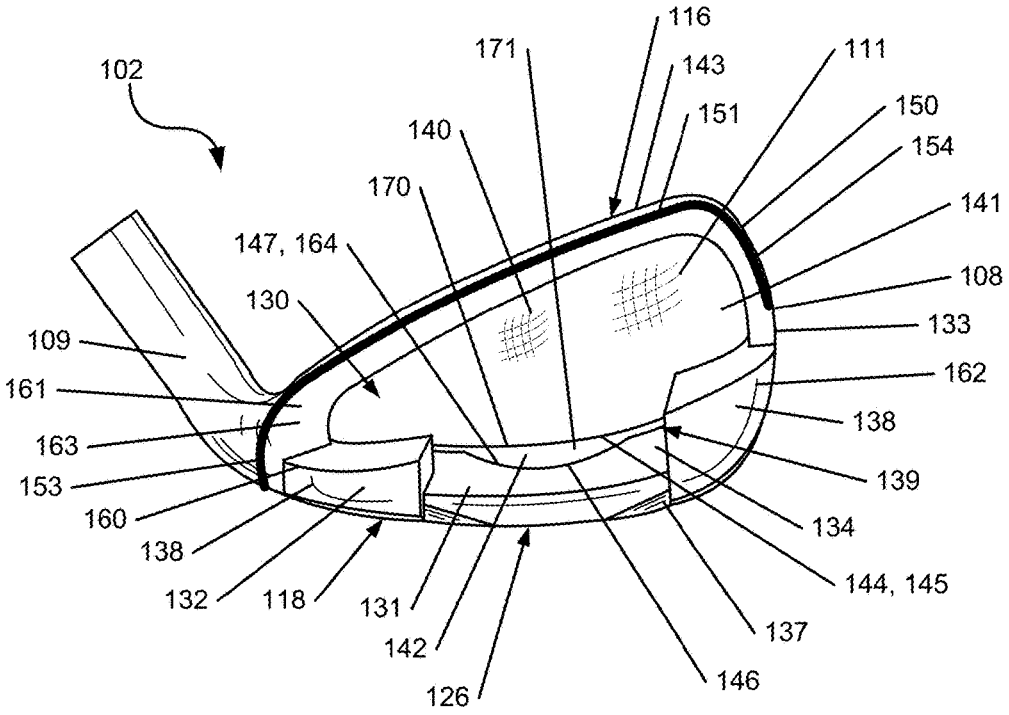
FIG. 3 is a rear view of the head of FIG. 2.

The sole member 131 and the rear wall 133 shown in FIGS. 2-7 are formed in a configuration that can achieve greater weight distribution around the heel 120 and the toe 122 of the head 102, which may increase the moment of inertia (MOI) of the club head 102. The outer surface 135 of the sole member 131 forms a keel 136 on the sole 118 of the head 102, and the sole member 131 also has two chamfered or beveled surfaces 137 angling away from the keel 136. The head 102 further includes heel and toe weighted portions 138 that increase the weight at the heel 120 and toe 122 of the head 102. Additionally, the weighted portions 138 extend rearward on the sole member 131 and extend upward from the sole member 131 to form the rear wall 132. As shown in FIG. 3, the rear wall 132 does not extend across the entire rear 126 of the head 102 and does not completely enclose the cavity 130, having a slot 139 defined therein between the weighted portions 138. However, in another embodiment, the rear wall 132 may extend completely across the rear 126 of the head 102.

In one embodiment, the head 102 is constructed from multiple pieces that are connected together by an integral joining technique. In the embodiment illustrated in FIGS. 2-7, the head 102 is formed of a face piece or face member 140 and a body piece or body member 160, joined together by an integral joining technique. In one embodiment, the face member 140 and the body member 160 are joined together by welding (including brazing, soldering, etc.), forming at least one weld line 150 between the face member 140 and the body member 160. In this embodiment, the face member 140 and the body member 160 are joined together by a continuous or generally continuous weld line 150 that extends in a loop around the entire juncture between the members 140, 160. In other embodiments, the face member 140 and the body member 160 may be joined differently, including by a different integral joining technique. As shown in FIGS. 2-7, in this embodiment, the face member 140 and the body member 160 are each formed of single pieces. However, it is understood that one or both of the face member 140 and the body member 160 may be formed of separate pieces joined together, such as by an integral joining technique.

Figure 4:
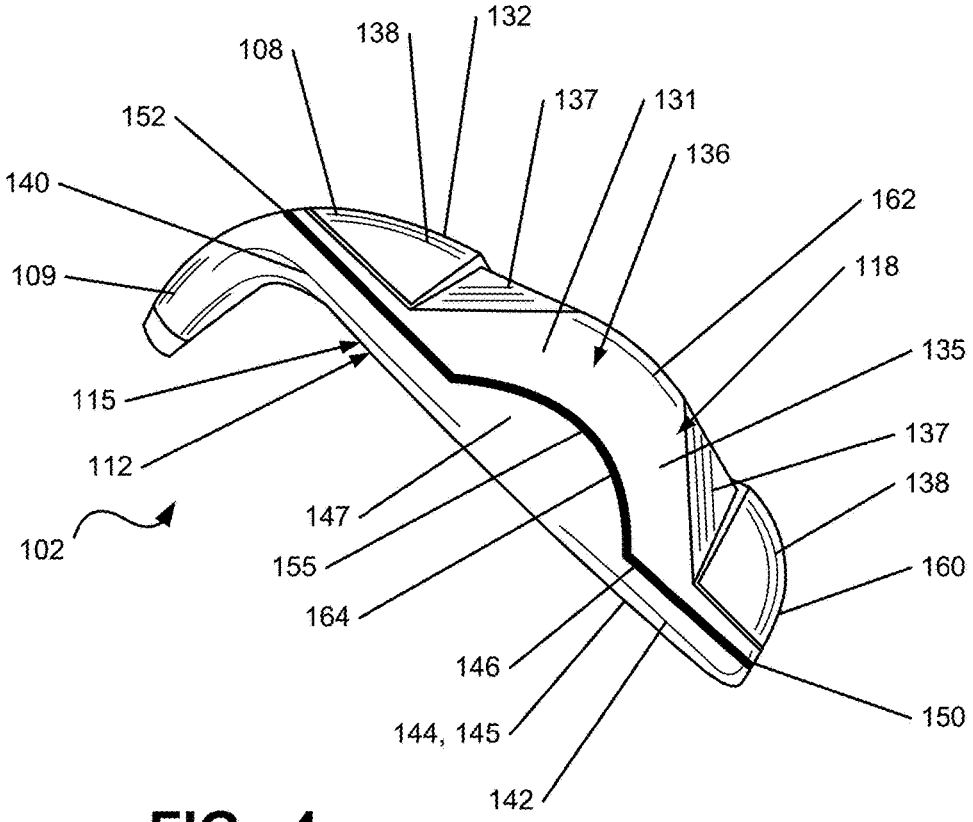
FIG. 4 is a bottom view of the head of FIG. 2.
Figure 5:
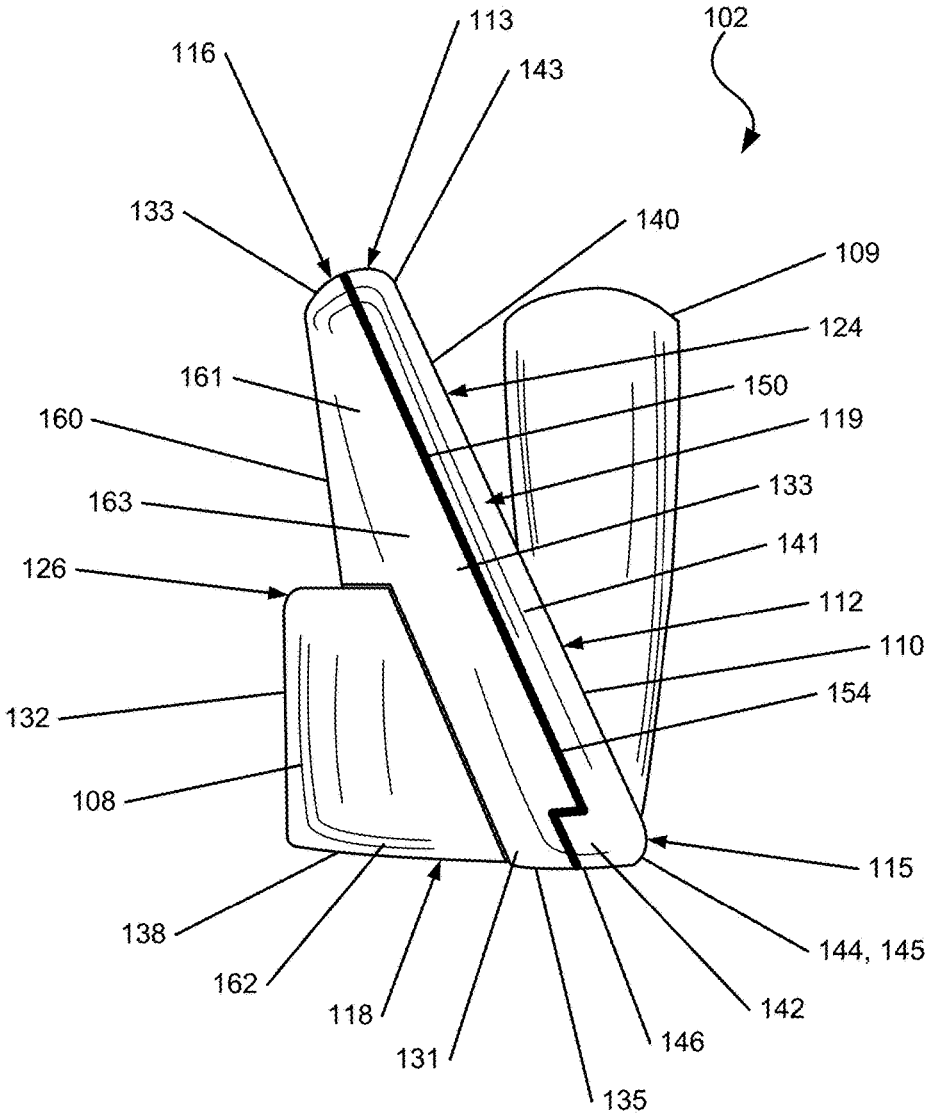
FIG. 5 is a side view of the head of FIG. 2.
Figure 6:
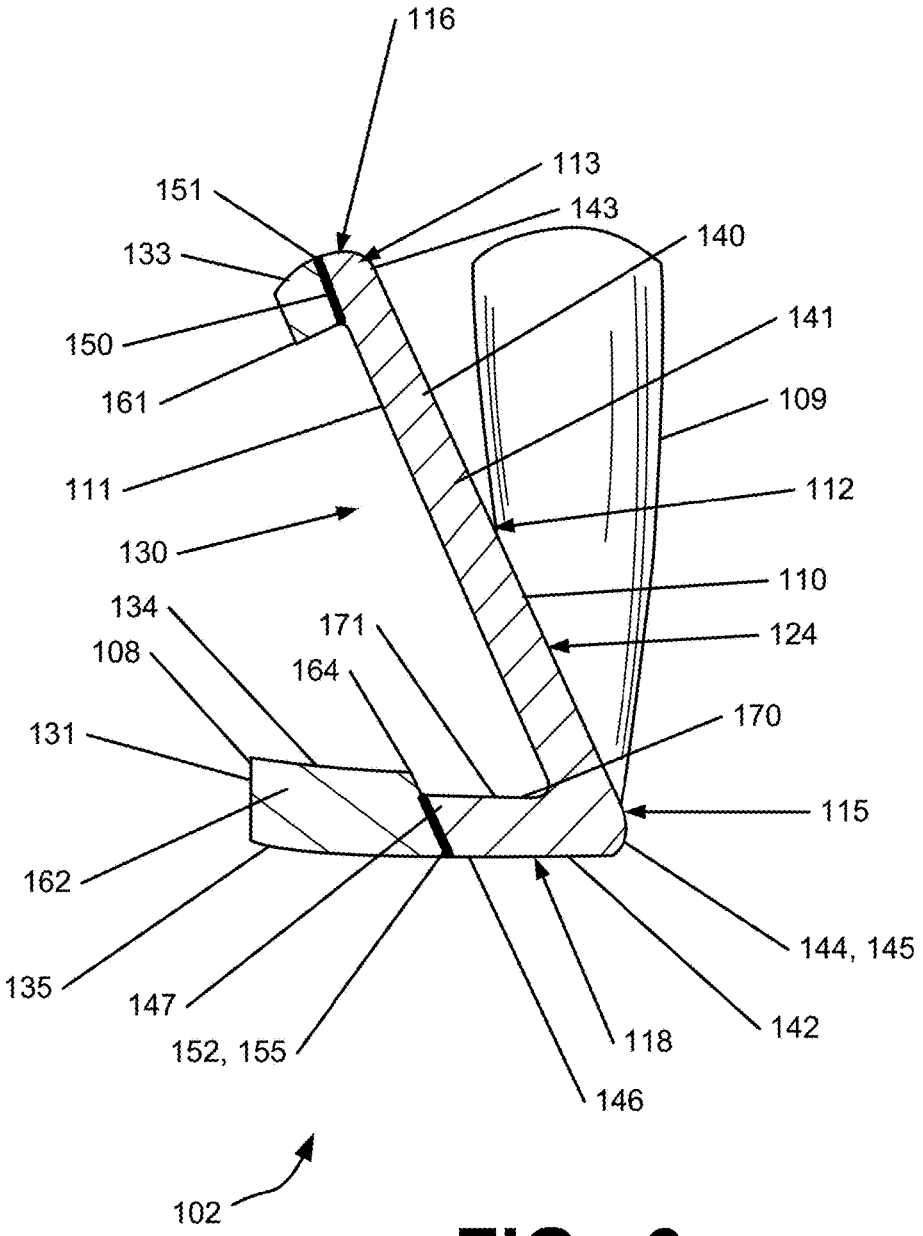
FIG. 6 is a cross-section view of the head of FIG. 2, taken along lines 6-6 of FIG. 2.
Figure 7:
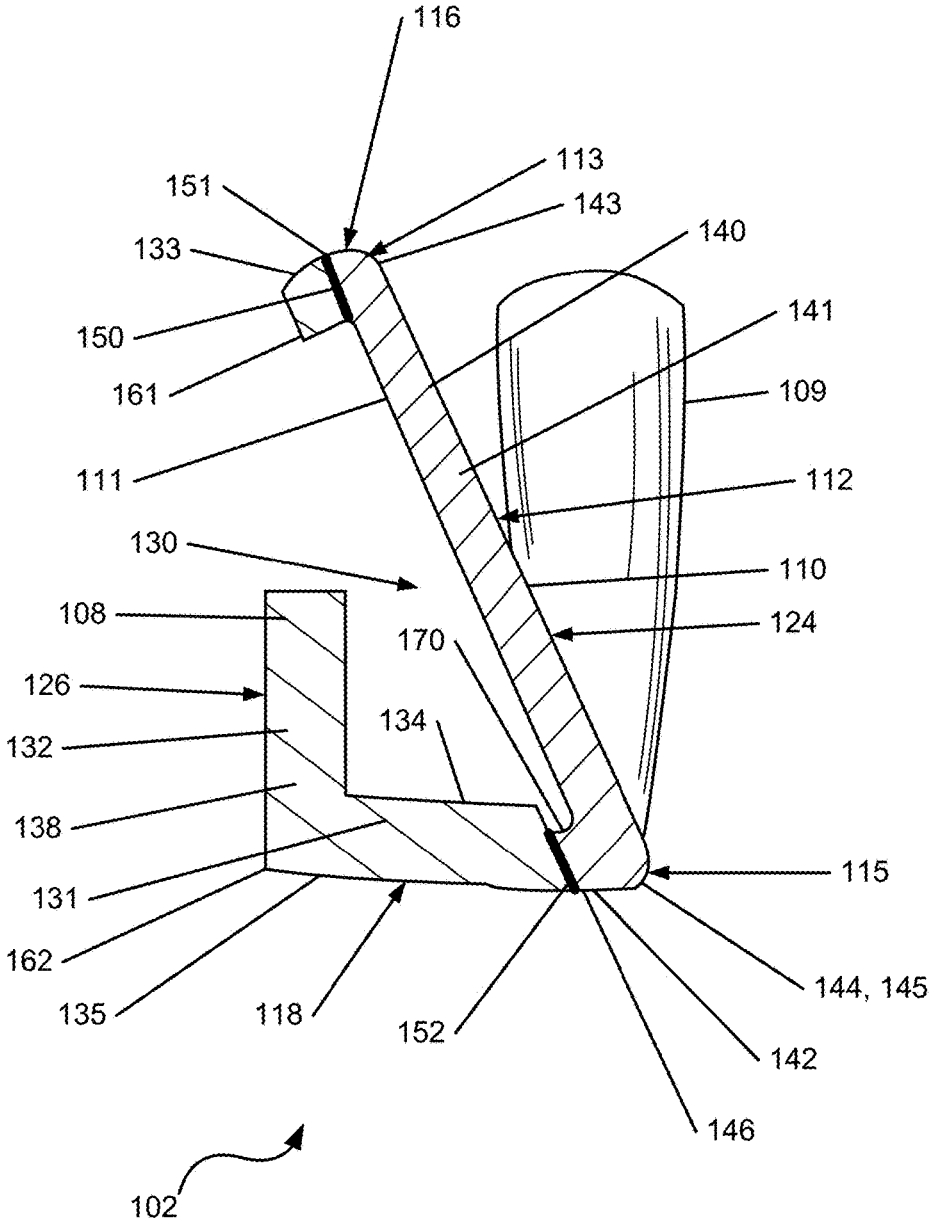
FIG. 7 is a cross-section view of the head of FIG. 2, taken along lines 7-7 of FIG. 2.

In the embodiment of FIGS. 2-7, the face member 140 includes at least a first leg 141 and a second leg 142, where the first leg 141 extends in a generally vertical direction to form at least a portion of the face 112 and the second leg 142 extends in a generally horizontal direction to form at least a portion of the sole member 131, and in this embodiment, the face member 140 has a generally L-shaped configuration when viewed in cross-section, as shown in FIGS. 6-7. The face member 140 may contain other components, such as those described in other embodiments below. In this embodiment, the first leg 141 of the face member 140 forms the entire face 112 of the head 102, including the entire ball striking surface 110 and the entire thickness from the ball striking surface 110 to the rear surface 111. The first leg 141 has a first or top end 143 that extends to form the top edge 113 of the face 112 and a portion of the top side 116 of the head 102, and a second or bottom end 144 that extends to the bottom edge 115 of the face 112. Additionally, the first leg 141 forms portions of the peripheral walls 133 of the head 102, as shown in FIGS. 3-5. In this embodiment, the second leg 142 of the face member 140 forms part of the inner surface 134 and the outer surface 135 of the sole member 131, and thus, forms part of the sole 118 and defines a portion of the rear cavity 130. The second leg 142 has a first or front end 145 that is connected to the bottom end 144 of the first leg 141 at the bottom edge 115 of the face and extends rearwardly to a second or rear end 146 located rearward from the front end 145. Further, in the embodiment shown in FIGS. 2-7, the hosel 109 is integrally formed with the face member 140 as a single piece. However, in other embodiments, part or all of the hosel 109 may be formed as part of the body member 160, or may be a separate piece connected to the head 102.

As shown in FIGS. 3-7, the second leg 142 of the face member 140 has a projection or projecting portion 147 extending from the rear end 146 at or near the centerline of the face member 140. The projecting portion 147 extends a greater distance rearward from the bottom edge 115 of the face 112 and from the bottom end 144 of the first leg 141 than adjacent portions of the second leg 142. As a result, the second leg 142 of the face member 140 has a greater front-to-rear length around the centerline of the face 112 than proximate the heel or toe edges 117, 119 of the face 112, as illustrated in FIGS. 6-7. In this embodiment, the rear end 146 of the second leg 142 forms a generally straight edge, and the projecting portion 147 projects from the rear end 146 and has a smooth curvilinear edge contour. In other embodiments, the second leg 142 may have a differently-shaped projecting portion, such as in FIGS. 13 and 18, or may have no definable projecting portion.

The body member 160 in the embodiment of FIGS. 2-7 extends from the top 116 to the sole 118 of the head 102, and extends from the face member 140 to the rear 126 of the head 102. The body member 160 includes a top portion 161 that is connected to the top end 143 of the first leg 141 of the face member 140 and forms at least a portion of the top side 116 of the head 102, and a bottom portion 162 that is connected to the rear end 146 of the second leg 142 of the face member 140 and forms at least part of the sole member 131 and the sole side 118 of the head 102. The bottom portion 162 of the body member 160 also includes an indent or indented portion 164 that is cooperatively dimensioned with the projecting portion 147 of the face member 140 such that the projecting portion 147 is received within the indent 164 when the face member 140 is connected to the body member 160. In this embodiment, the body member 160 also includes the rear wall 132, which extends upward from the bottom portion 162 of the body member 160, as well as the heel and toe weighted portions 138 and the adjacent chamfered surfaces 137. The body member 160 further includes side walls 163 extending rearwardly from the edges 113, 115, 117, 119 of the face and connecting the top and bottom portions 161, 162. As shown in FIGS. 3-7, the body member 160 forms portions of the peripheral walls 133 of the head 102, in combination with portions of the face member 140. Additionally, the inner surfaces of the top portion 161, the bottom portion 162, the side walls 163, and the rear wall 132 of the body portion 160 define internal surfaces of the rear cavity 130.

As stated above, in one embodiment, the face member 140 and the body member 160 can be joined together using an integral joining technique along part or all of the juncture between the face member 140 and the body member 160. In the embodiment shown in FIGS. 2-7, the face member 140 is welded to the body member 160 along a peripheral weld line 150 that extends continuously around the periphery of the face 112 and across the sole 118 at the juncture between the face member 140 and the body member 160. This welding can be accomplished using, plasma welding or laser welding, to minimize the material added and the size of the heat-affected zone of the joint, although TIG or other types of welding may also be used. The weld line 150 includes one laterally-extending weld line segment 151 extending across the peripheral wall 133 on the top 116 of the head 102, another laterally-extending weld line segment 152 extending across the sole member 131 on the sole 118 of the head 102, and two vertically-extending weld line segments 153, 154 extending along the peripheral walls 133 on the heel 120 and toe 122 of the head 102 between the lateral weld lines 151, 152. The top lateral weld line 151 joins the top portion 161 of the body member 160 with the top end 143 of the first leg 141 of the face member 140. The bottom lateral weld line 152 joins the rear end 146 of the second leg 142 of the face member 140 to the bottom portion 162 of the body member 160. The bottom lateral weld line 152 in this embodiment also has a jog portion 155 that follows the juncture line between the projection 147 of the face member 140 and the indent 164 of the body member 160. The vertical weld lines 133 join the peripheral edges of the face member 140 to the side walls 163 of the body member 160. As shown in FIGS. 6-7, the weld line 150 extends over the entire juncture between the face member 140 and the body member 160 (e.g., through the entire thickness of the peripheral wall 133 and the sole member 131). However, in other embodiments, the weld line 150 may extend over less than the entire juncture, such as by extending intermittently rather than continuously or by extending through only a portion of the thickness of the juncture. Additionally, in other embodiments, the weld line may have a different configuration, which may depend on the configurations of the face member 140 and/or the body member 160. It is understood that the welded junction along the weld line 150 may require additional processing, such as milling/machining, in order to create a smooth and aesthetically-pleasing surface.

In one embodiment, the head 102 has a recessed channel 170 within the rear cavity 130 that runs laterally along the inner surface 134 of the sole member 131. In the embodiment shown in FIGS. 2-7, the channel 170 extends along the juncture line between the rear surface 111 of the face 112 and the sole member 131, and is defined by portions of the sole member 131 and the rear surface 111. As illustrated in FIGS. 3, 6, and 7, the channel 170 is created by a difference in height between the bottom portion 162 of the body member 160 and the second leg 142 of the face member 140, and the channel 170 is recessed with respect to the top surface of the bottom portion 162 of the body member 160. Additionally, the channel 170 is defined between the bottom portion 162 of the body member 160, the second leg 142 of the face member 140, and the rear surface 111 of the face 112, and the channel 170 spaces the body member 160 from the rear surface 111 of the face. As also illustrated in FIGS. 3, 6, and 7, the channel 170 includes a widened portion 171 proximate the centerline of the head 102, created by the combination of the projection 147 of the face member 140 and the indent 164 of the body member 160, which result in greater space between the body member 160 and the rear surface 111 of the face 112 at the widened portion 171. In this embodiment, the channel 170 extends the entire width of the rear cavity 130, ending at the perimeter walls 133 at the heel 120 and toe 122 of the head 102. In other embodiments, the channel 170 may have a different width or a different shape, or may otherwise be differently configured, as described in several embodiments below. For example, in another embodiment, the channel 170 may be defined entirely within the face member 140 or the body member 160, such as by a groove or similar structure formed in the face member 140 or the body member 160, and may not be created by a difference in height between the two members 140, 160.

FIGS. 8-11 illustrate a second embodiment of a ball-striking device 200 having a ball striking head 202 in the form of an iron-type golf club. Many features of the club 200 and the head 202 shown in FIGS. 8-11 are similar to features described above with respect to the club 100 and the head 102 in FIGS. 1-7. Such similar features are referenced in FIGS. 8-11 with similar reference numerals, using the "2xx" series of reference numerals. Accordingly, some features of the club 200 and the head 202 in FIGS. 8-11 that are similar to the features of the club 100 and head 102 in FIGS. 1-7 may not be re-described or may be described in lesser detail below, and some features of the club 200 and the head 202 may be described only with respect to the differences from the club 100 and the head 102 in FIGS. 1-7. As such, certain drawing figures may be unnecessary and duplicative of other drawing figures herein.

The head 202 of FIGS. 8-11 has a face 212, a body 208 connected to the face 212, and a hosel 209, and is formed of a face member 240 and a body member 260, similarly to the head 102 of FIGS. 1-7. The head 202 also has a sole member 231 with a rear wall 232 extending upward from the sole member 231, as well as a rear cavity 230 defined by the sole member 231, the rear wall 232, the peripheral walls 233, and the inner surface 211 of the face 212. In this embodiment, the rear wall 232 extends across the entire rear 226 of the head 202, and does not contain the weighted portions 138 separated by the slot 139 of the head 102 of FIGS. 1-7. Additionally, the sole member 231 has a substantially smooth outer surface 235 that does not contain the beveled surfaces 137 and other sole 118 features of the head 102 of FIGS. 1-7. In general, the structural features of the head 202 are otherwise similar to those of the head 102 in FIGS. 1-7.

Figure 8:
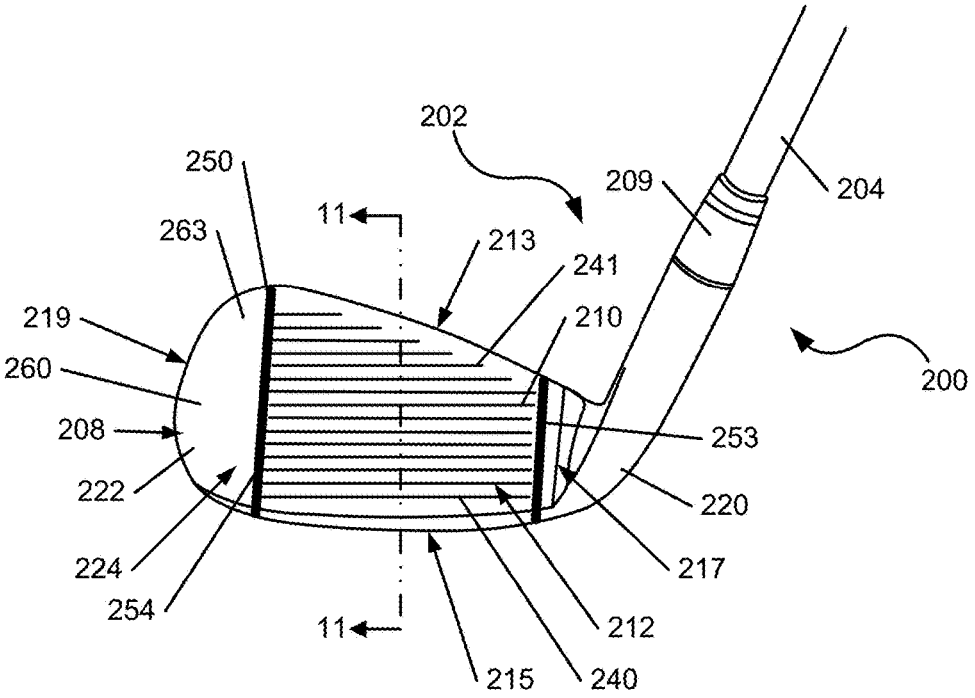
FIG. 8 is a front view of a second illustrative embodiment of a head of a ball striking device.
Figure 9:
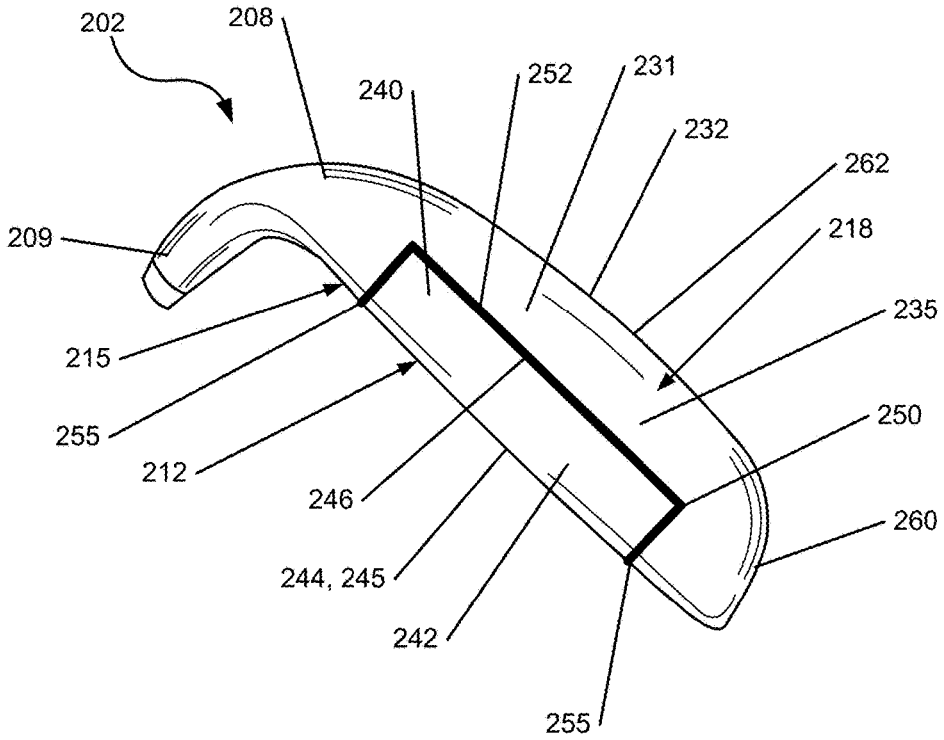
FIG. 9 is a rear view of the head of FIG. 8.
Figure 10:
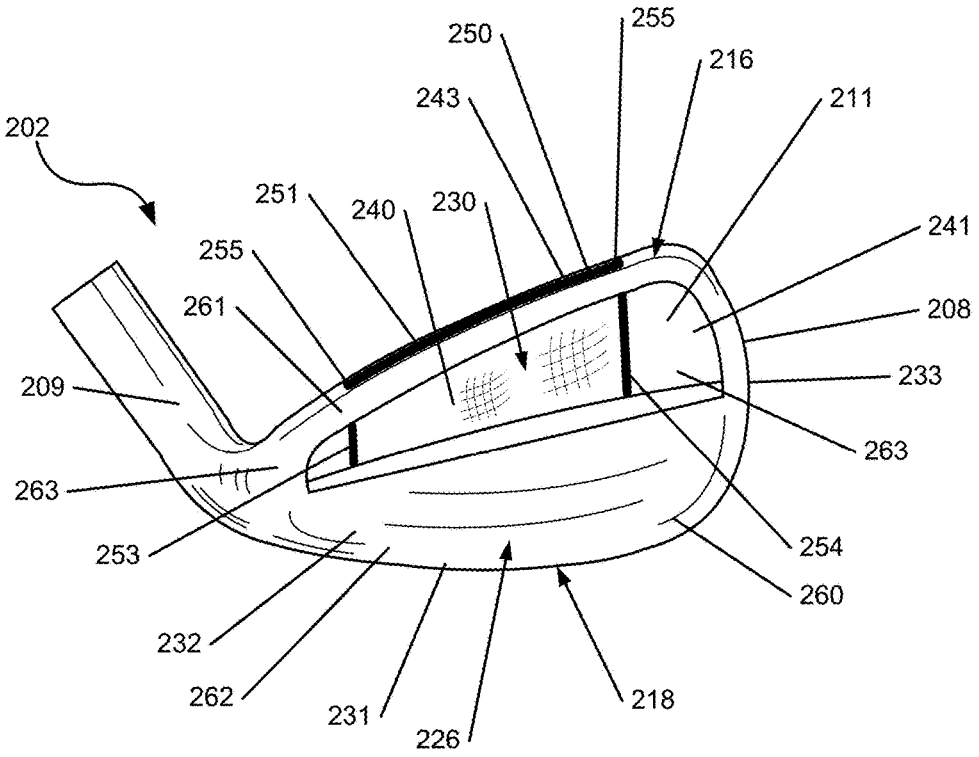
FIG. 10 is a bottom view of the head of FIG. 8.
Figure 11:
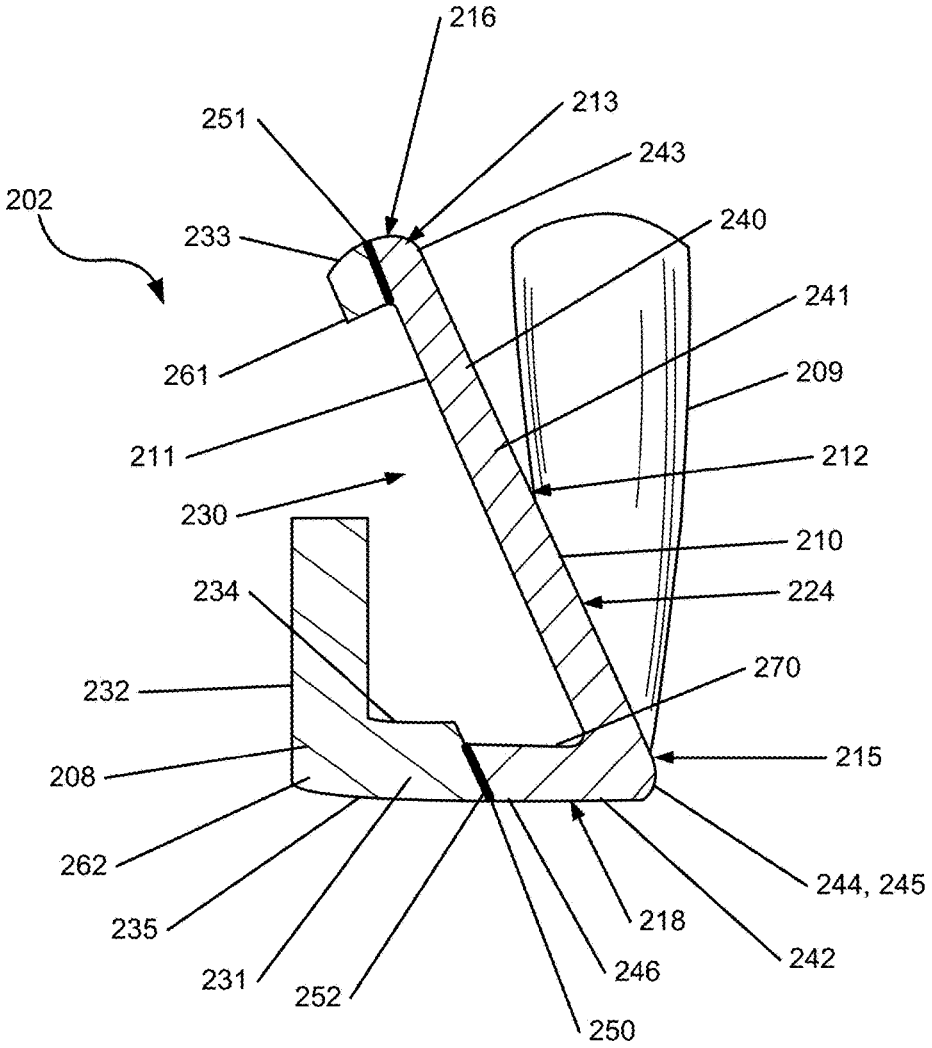
FIG. 11 is a cross-section view of the head of FIG. 8, taken along lines 11-11 of FIG. 8.

In the embodiment of FIGS. 8-11, the head 202 is formed of a face member 240 and a body member 260 that have different configurations from the face member 140 and the body member 160 in FIGS. 1-7. In this embodiment, the face member 240 has a first leg 241 and a second leg 242, and has a generally L-shaped configuration when viewed in cross-section. The first leg 241 of the face member 240 forms a portion of the face 212 of the head 202 and a portion of the ball striking surface 210. The first leg 241 extends from the top edge 213 to the bottom edge 215 of the face 212, and extends through the entire thickness of the face 212 from the ball striking surface 210 to the rear surface 211. However, the body member 260 also forms a portion of the face 212, and the first leg 241 does not extend to the heel and toe edges 217, 219. The first leg 241 has a first or top end 243 that extends to form the top edge 213 of the face 212 and a portion of the top side 216 of the head 202, and a second or bottom end 244 that extends to the bottom edge 215 of the face 212. As shown in FIG. 8, the first leg 241 of the face member 240 forms the entire portion of the ball striking surface 210 that is configured for impacting a ball in play. Additionally, the first leg 241 forms portions of the peripheral wall 233 on the top side 213 of the head 202, as shown in FIGS. 10-11. In this embodiment, the second leg 242 of the face member 240 forms part of the inner surface 234 and the outer surface 235 of the sole member 231, and thus, forms part of the sole 218 and defines a portion of the rear cavity 230. The second leg 242 has a first or front end 245 that is connected to the bottom end 244 of the first leg 241 at the bottom edge 215 of the face and extends rearwardly to a second or rear end 246 located rearward from the front end 245. As seen in FIG. 9, the rear end 246 of the second leg 242 of the face member 240 has a substantially straight edge, and does not contain a projection or other significant variance in front-to-rear length such as the face member 140 of the head 102 of FIGS. 2-7.

The body member 260 in the embodiment of FIGS. 8-11 extends from the top 216 to the sole 218 of the head 202, and extends from the face member 240 to the rear 226 of the head 202. The body member 260 includes a top portion 261 that is connected to the top end 243 of the first leg 241 of the face member 240 and forms at least a portion of the top side 216 of the head 202, and a bottom portion 262 that is connected to the rear end 246 of the second leg 242 of the face member 240 and forms at least part of the sole member 231 and the sole side 218 of the head 202. In this embodiment, the body member 260 also includes the rear wall 232, which extends upward from the bottom portion 262 of the body member 260. The body member 260 further includes side walls 263 that form portions of the face 212 at the heel 220 and the toe 222 of the head, and extend rearwardly from the edges 113, 115, 117, 119 of the face 212 to connect the top and bottom portions 261, 262. As shown in FIGS. 9-10, the body member 260 forms portions of the peripheral walls 233 of the head 202, in combination with portions of the face member 240. Additionally, the inner surfaces of the top portion 261, the bottom portion 262, the side walls 263, and the rear wall 232 of the body portion 260 define internal surfaces of the rear cavity 230. Further, in the embodiment shown in FIGS. 8-11, the hosel 209 is integrally formed with the body member 260 as a single piece, which differs from the head 102 in FIGS. 1-7.

In the embodiment shown in FIGS. 8-11, the face member 240 is welded to the body member 260 along a weld line 250 that extends continuously along a portion of the periphery of the face 212 on the top 216 of the head 202, vertically across the face 212, and across the sole 218 at the juncture between the face member 240 and the body member 260. The weld line 250 includes one laterally-extending weld line segment 251 extending across the peripheral wall 233 on the top 216 of the head 202, another laterally-extending weld line segment 252 extending across the sole member 231 on the sole 218 of the head 202, two vertically-extending weld line segments 253, 254 extending between the lateral weld lines 251, 252 from the top edge 213 to the bottom edge 215 of the face 212 on both sides of the center of the head 202, and longitudinal connecting segments 255 on the top 213 and the sole 218 that connect the vertical weld lines 253, 254 to the lateral weld lines 251, 252. As shown in FIG. 8, the vertical weld lines 253, 254 do not extend across the portion of the ball striking surface 210 configured for contacting the ball. The top lateral weld line 251 joins the top portion 261 of the body member 260 with the top end 243 of the first leg 241 of the face member 240. The bottom lateral weld line 252 joins the rear end 246 of the second leg 242 of the face member 240 to the bottom portion 262 of the body member 260. The vertical weld lines 233 join the peripheral edges of the face member 240 to the side walls 263 of the body member 260. As shown in FIG. 11, the weld line 250 extends over the entire juncture between the face member 240 and the body member 260 (e.g., through the entire thickness of the face 212, the peripheral wall 233, and the sole member 231).

In this embodiment, the head 202 has a recessed channel 270 within the rear cavity 230 that runs laterally along the inner surface 234 of the sole member 231, along the juncture line between the inner surface 211 of the face 212 and the sole member 231. The channel 270 is defined by portions of the sole member 231 and the inner surface 211. As illustrated in FIG. 11, the channel 270 is created by a difference in height between the bottom portion 262 of the body member 260 and the second leg 242 of the face member 240, and the channel 270 is recessed with respect to the top surface of the bottom portion 262 of the body member 260. Additionally, the channel 270 is defined between the bottom portion 262 of the body member 260, the second leg 242 of the face member 240, and the inner surface 211 of the face 212, and the channel 270 spaces the body member 260 from the inner surface 211 of the face 212. As shown in FIG. 8, the second leg 242 of the face member 240 does not extend the entire lateral width of the rear cavity 230, and, in this embodiment, the channel 270 extends only over the lateral width of the face member 240 and less than the entire width of the rear cavity 230.

FIGS. 12-16 illustrate a third embodiment of a ball-striking device 300 having a ball striking head 302 in the form of an iron-type golf club. Many features of the club 300 and the head 302 shown in FIGS. 12-16 are similar to features described above with respect to the club 100 and the head 102 in FIGS. 1-7. Such similar features are referenced in FIGS. 12-16 with similar reference numerals, using the "3xx" series of reference numerals. Accordingly, some features of the club 300 and the head 302 in FIGS. 12-16 that are similar to the features of the club 100 and head 102 in FIGS. 1-7 may not be re-described or may be described in lesser detail below, and some features of the club 300 and the head 302 may be described only with respect to the differences from the club 100 and the head 102 in FIGS. 1-7. As such, certain drawing figures may be unnecessary and duplicative of other drawing figures herein.

The head 302 of FIGS. 12-16 has a face 312, a body 308 connected to the face 312, and a hosel 309, and is formed of a face member 340 and a body member 360, similarly to the head 102 of FIGS. 1-7. The head 302 also has a sole member 331 with a rear wall 332 extending upward from the sole member 331, as well as a rear cavity 330 defined by the sole member 331, the rear wall 332, the peripheral walls 333, and the inner surface 311 of the face 312. In this embodiment, the rear wall 332 extends across the entire rear 326 of the head 302, similarly to the head 202 of FIGS. 8-11. Additionally, the sole member 331 has a substantially smooth outer surface 335, similarly to the head 202 of FIGS. 8-11. In general, the structural features of the head 302 are otherwise similar to those of the head 102 in FIGS. 1-7.

Figure 12:
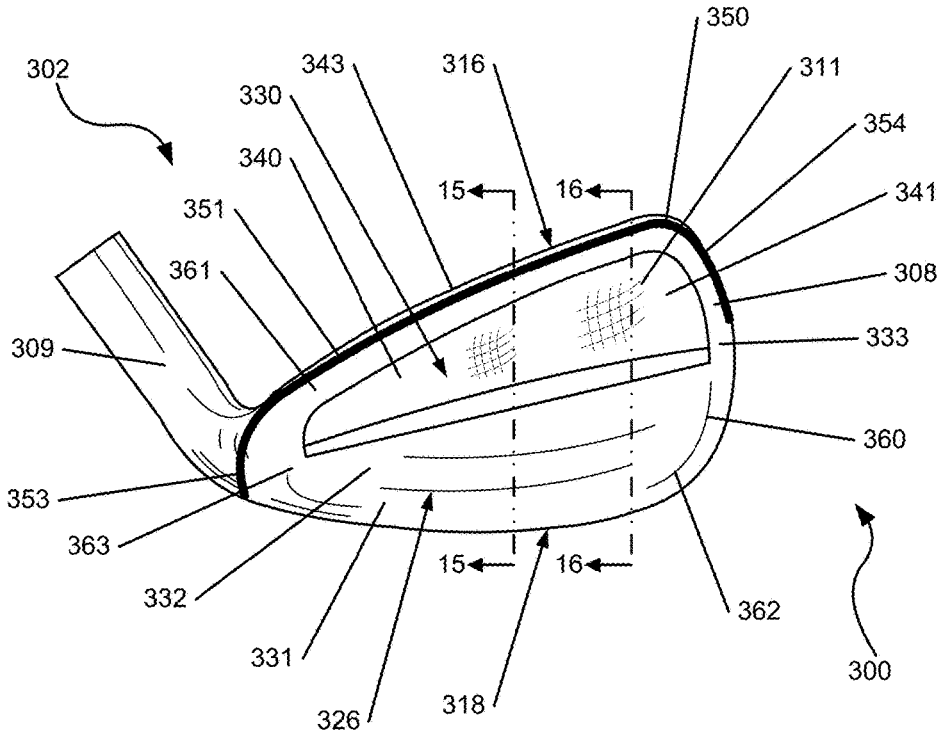
FIG. 12 is a rear view of a third illustrative embodiment of a head of a ball striking device.
Figure 13:
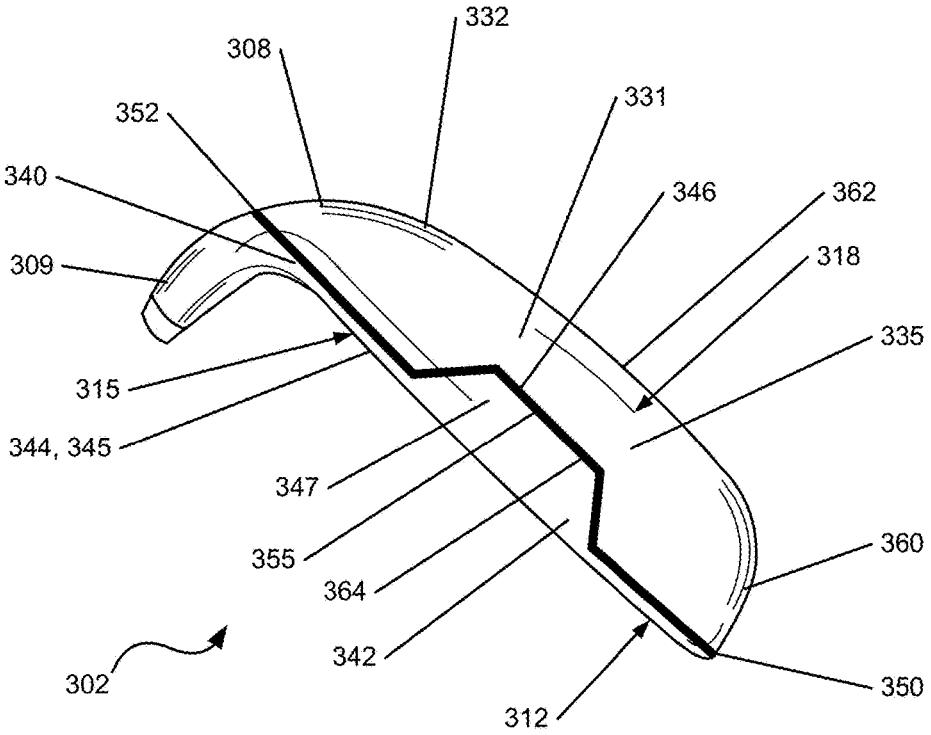
FIG. 13 is a bottom view of the head of FIG. 12.
Figure 14:
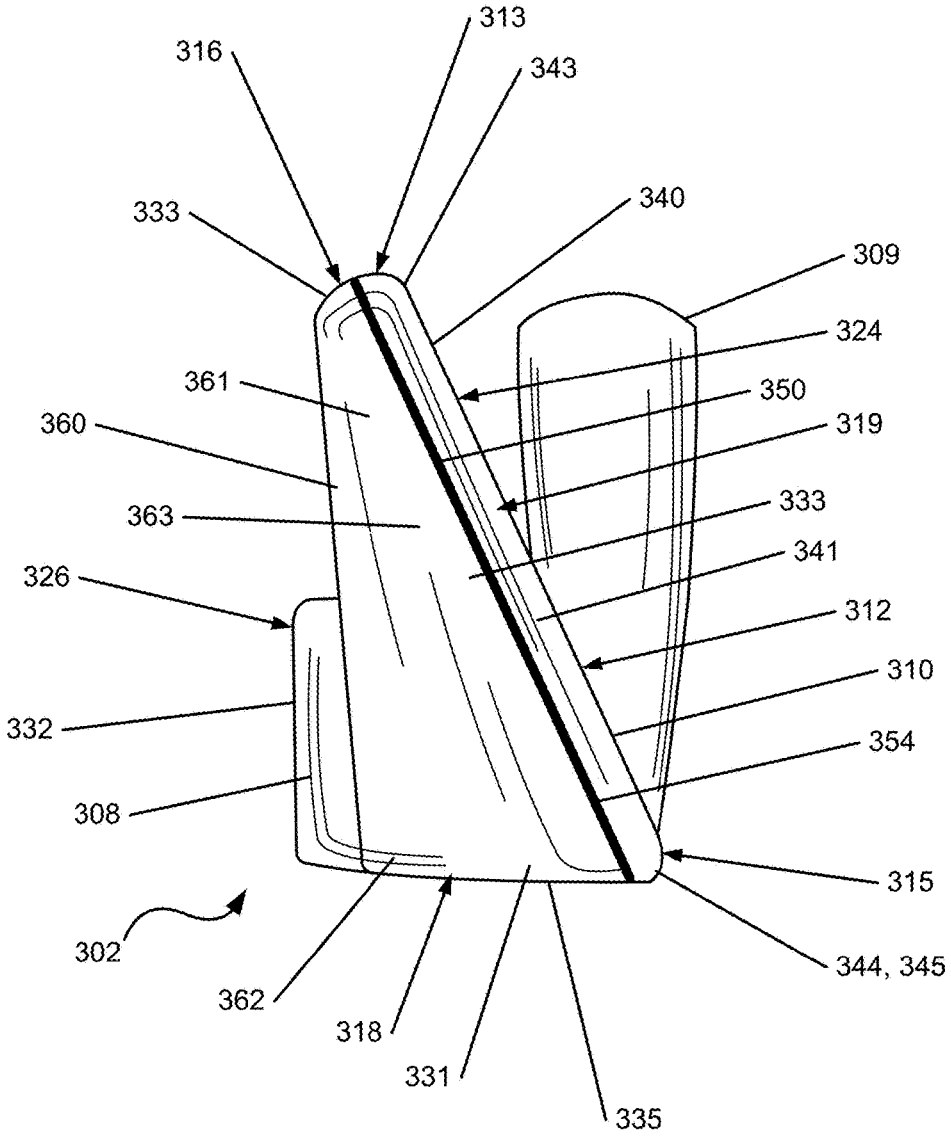
FIG. 14 is a side view of the head of FIG. 12.
Figure 15:
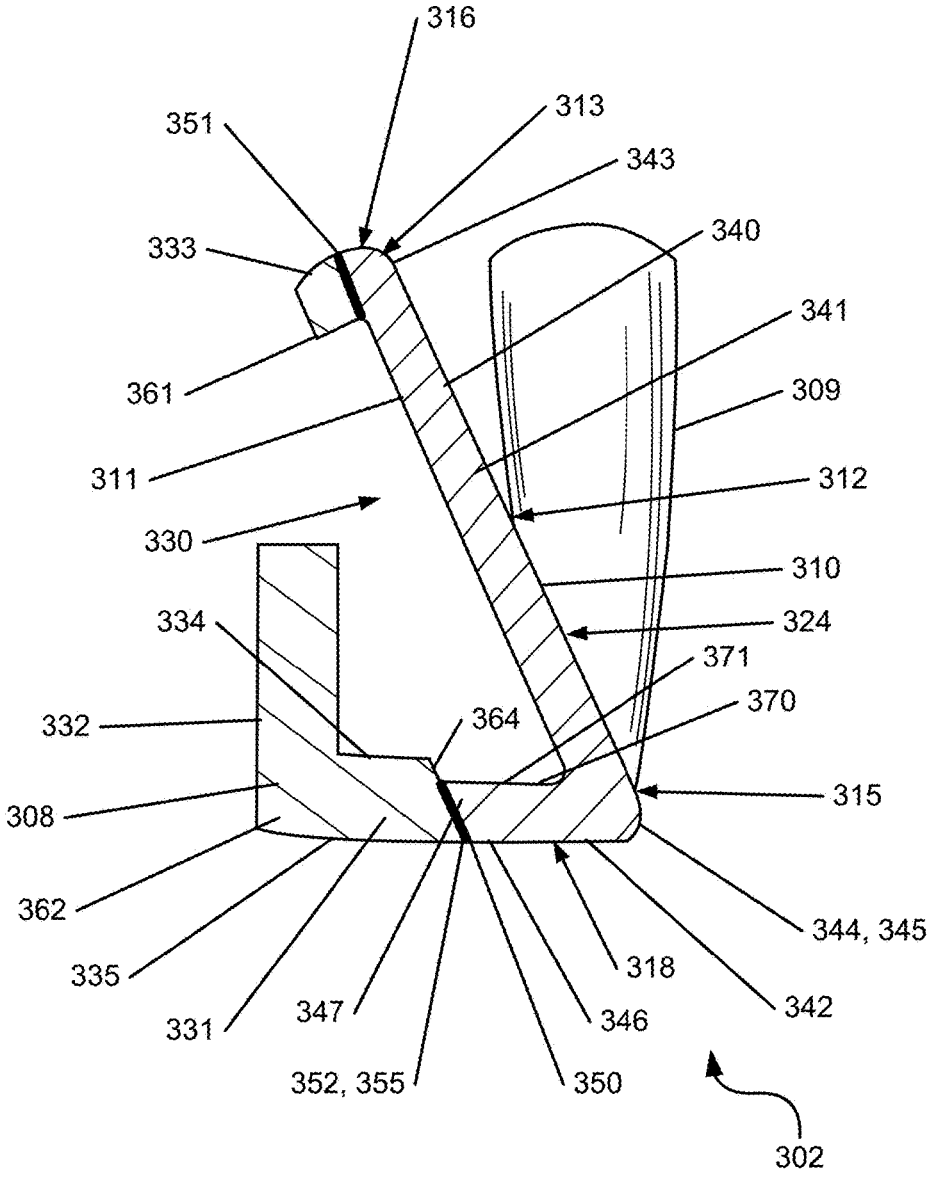
FIG. 15 is a cross-section view of the head of FIG. 12, taken along lines 15-15 of FIG. 12.

In the embodiment of FIGS. 12-16, the head 302 is formed of a face member 340 and a body member 360 that have different configurations from the face members 140, 240 and the body members 160, 260 described above. In this embodiment, the face member 340 has a first leg 341 and a second leg 342, and has a generally L-shaped configuration when viewed in cross-section. The first leg 341 of the face member 340 forms the entire face 312 of the head 302, including the entire ball striking surface 310 and the entire thickness from the ball striking surface 310 to the rear surface 311. The first leg 341 has a first or top end 343 that extends to form the top edge 313 of the face 312 and a portion of the top side 316 of the head 302, and a second or bottom end 344 that extends to the bottom edge 315 of the face 312. Additionally, the first leg 341 forms portions of the peripheral walls 333 of the head 302, as shown in FIGS. 12-14. In this embodiment, the second leg 342 of the face member 340 forms part of the inner surface 334 and the outer surface 335 of the sole member 331, and thus, forms part of the sole 318 and defines a portion of the rear cavity 330. The second leg 342 has a first or front end 345 that is connected to the bottom end 344 of the first leg 341 at the bottom edge 315 of the face and extends rearwardly to a second or rear end 346 located rearward from the front end 345. In this embodiment, the second leg 342 of the face member 340 has a relatively narrow lateral width that is smaller than the lateral width of the first leg 341 of the face member 340. Accordingly, as shown in FIGS. 13 and 15, the second leg 342 of the face member 340 may be viewed as a trapezoid-shaped projection extending rearward from the bottom end 344 of the first leg 341 of the face member 340. In other embodiments, the second leg 342 may have a different shape. Further, in the embodiment shown in FIGS. 12-16, the hosel 309 is integrally formed with the face member 340 as a single piece.

The body member 360 in the embodiment of FIGS. 12-16 extends from the top 316 to the sole 318 of the head 302, and extends from the face member 340 to the rear 326 of the head 302. The body member 360 includes a top portion 361 that is connected to the top end 343 of the first leg 341 of the face member 340 and forms at least a portion of the top side 316 of the head 302, and a bottom portion 362 that is connected to the rear end 346 of the second leg 342 and the bottom end 344 of the first leg 341 of the face member 340 and forms at least part of the sole member 331 and the sole side 318 of the head 302. The bottom portion 362 of the body member 360 also includes an indent or indented portion 364 that is cooperatively dimensioned with the projecting second leg 342 of the face member 340 such that the second leg 342 is received within the indent 364 when the face member 340 is connected to the body member 360. In this embodiment, the body member 360 also includes the rear wall 332, which extends upward from the bottom portion 362 of the body member 360. The body member 360 further includes side walls 363 extending rearwardly from the edges 313, 315, 317, 319 of the face and connecting the top and bottom portions 361, 362. As shown in FIGS. 12-16, the body member 360 forms portions of the peripheral walls 333 of the head 302, in combination with portions of the face member 340. Additionally, the inner surfaces of the top portion 361, the bottom portion 362, the side walls 363, and the rear wall 332 of the body portion 360 define internal surfaces of the rear cavity 330.

In the embodiment shown in FIGS. 12-16, the face member 340 is welded to the body member 360 along a weld line 350 that extends continuously around the periphery of the face 312 and across the sole 318 at the juncture between the face member 340 and the body member 360. The weld line 350 includes one laterally-extending weld line segment 351 extending across the peripheral wall 333 on the top 316 of the head 302, another laterally-extending weld line segment 352 extending across the sole member 331 on the sole 318 of the head 302, and two vertically-extending weld line segments 353, 354 extending along the peripheral walls 333 on the heel 320 and toe 322 of the head 302 between the lateral weld lines 351, 352. The top lateral weld line 351 joins the top portion 361 of the body member 360 with the top end 343 of the first leg 341 of the face member 340. The bottom lateral weld line 352 joins the second leg 342 and the bottom end 344 of the first leg 341 of the face member 340 to the bottom portion 362 of the body member 360. The bottom lateral weld line 352 in this embodiment also has a jog portion 355 that follows the juncture line between the second leg 342 of the face member 340 and the indent 364 of the body member 360. The vertical weld lines 333 join the peripheral edges of the face member 340 to the side walls 363 of the body member 360. As shown in FIGS. 12-16, the weld line 350 extends over the entire juncture between the face member 340 and the body member 360 (e.g., through the entire thickness of the peripheral wall 333 and the sole member 331).

Figure 16:
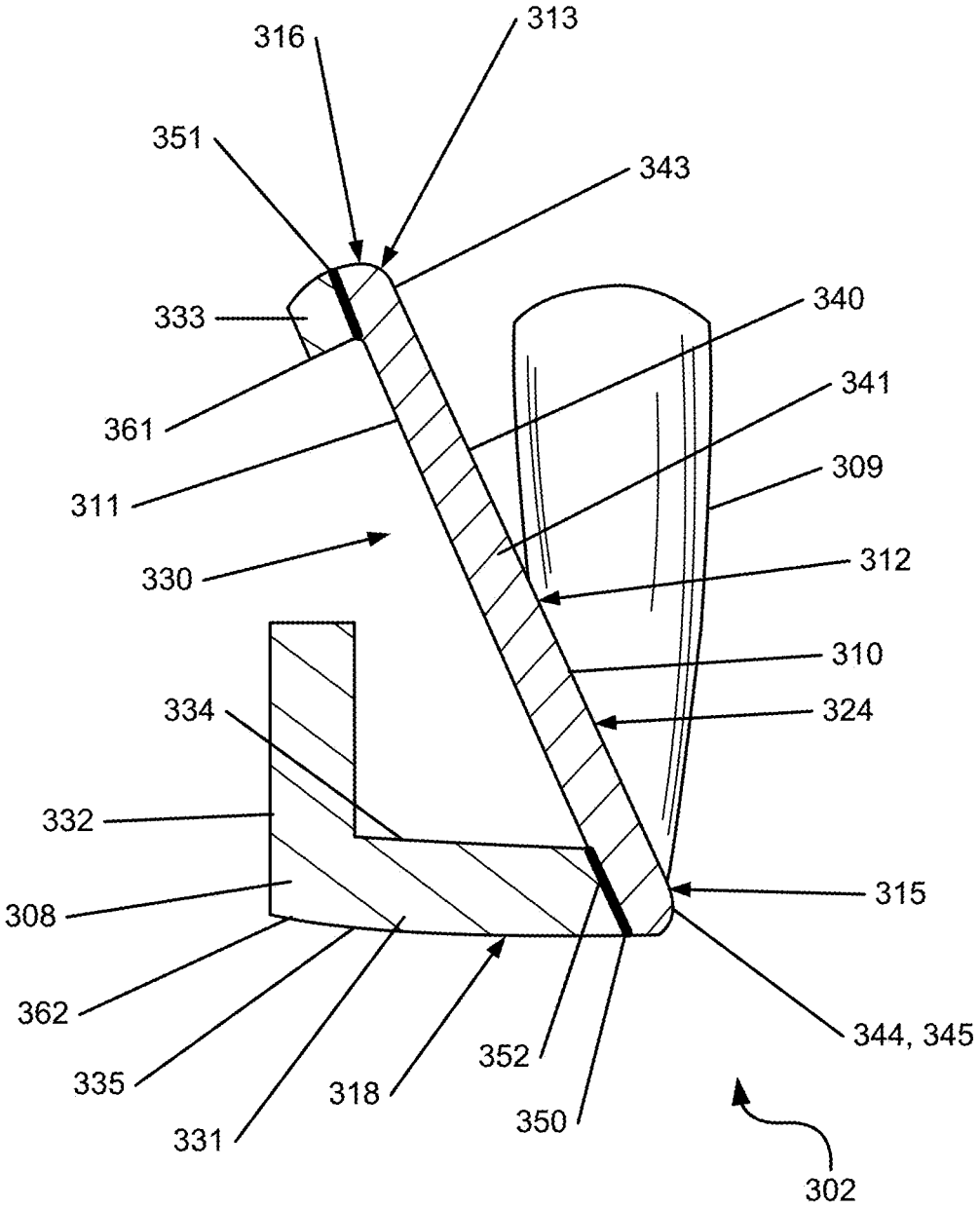
FIG. 16 is a cross-section view of the head of FIG. 12, taken along lines 16-16 of FIG. 12.

In this embodiment, the head 302 has a recessed channel 370 within the rear cavity 330 that runs laterally along the inner surface 334 of the sole member 331, along the juncture line between the inner surface 311 of the face 312 and the sole member 331. The channel 370 is defined by portions of the sole member 331 and the inner surface 311. As illustrated in FIGS. 15 and 16, the channel 370 is created by a difference in height between the bottom portion 362 of the body member 360 and the second leg 342 of the face member 340, and the channel 370 is recessed with respect to the top surface of the bottom portion 362 of the body member 360. Additionally, the channel 370 is defined between the bottom portion 362 of the body member 360, the second leg 342 of the face member 340, and the inner surface 311 of the face 312, and the channel 370 spaces the body member 360 from the inner surface 311 of the face 312. As shown in FIG. 13, the second leg 342 of the face member 340 does not extend the entire lateral width of the rear cavity 330 or the entire lateral width of the first leg 341, and, in this embodiment, the channel 370 extends only over the lateral width of the second leg 342 of the face member 240 and less than the entire width of the rear cavity 330.

FIGS. 17-21 illustrate a fourth embodiment of a ball-striking device 400 having a ball striking head 402 in the form of an iron-type golf club. Many features of the club 400 and the head 402 shown in FIGS. 17-21 are similar to features described above with respect to the club 100 and the head 102 in FIGS. 1-7. Such similar features are referenced in FIGS. 17-21 with similar reference numerals, using the "4xx" series of reference numerals. Accordingly, some features of the club 400 and the head 402 in FIGS. 17-21 that are similar to the features of the club 100 and head 102 in FIGS. 1-7 may not be re-described or may be described in lesser detail below, and some features of the club 400 and the head 402 may be described only with respect to the differences from the club 100 and the head 102 in FIGS. 1-7. As such, certain drawing figures may be unnecessary and duplicative of other drawing figures herein.

The head 402 of FIGS. 17-21 has a face 412, a body 408 connected to the face 412, and a hosel 409, and is formed of a face member 440 and a body member 460, similarly to the head 102 of FIGS. 1-7. The head 402 also has a rearwardly-extending sole member 431, as well as a rear cavity 430 defined by the sole member 431, the peripheral walls 433, and the inner surface 411 of the face 412. In this embodiment, the sole member 431 has no rear wall defining the cavity 430. Additionally, the sole member 431 has a substantially smooth outer surface 435, similarly to the head 202 of FIGS. 8-11. In general, the structural features of the head 402 are otherwise similar to those of the head 102 in FIGS. 1-7.

In the embodiment of FIGS. 17-21, the head 402 is formed of a face member 440 and a body member 460 that have different configurations from the face members 140, 240, 340 and the body members 160, 260, 360 described above. In this embodiment, the face member 440 has a first leg 441 and a second leg 442, and has a generally L-shaped configuration when viewed in cross-section. The first leg 441 of the face member 440 forms the entire face 412 of the head 402, including the entire ball striking surface 410 and the entire thickness from the ball striking surface 410 to the rear surface 411. The first leg 441 has a first or top end 443 that extends to form the top edge 413 of the face 412 and a portion of the top side 416 of the head 402, and a second or bottom end 444 that extends to the bottom edge 415 of the face 412. Additionally, the first leg 441 forms portions of the peripheral walls 433 of the head 402, as shown in FIGS. 17-21. In this embodiment, the second leg 442 of the face member 440 forms part of the inner surface 434 and the outer surface 435 of the sole member 431, and thus, forms part of the sole 418 and defines a portion of the rear cavity 430. The second leg 442 has a first or front end 445 that is connected to the bottom end 444 of the first leg 441 at the bottom edge 415 of the face and extends rearwardly to a second or rear end 446 located rearward from the front end 445. As shown in FIGS. 17-21, the second leg 442 of the face member 440 has a projection or projecting portion 447 extending from the rear end 446 at or near the centerline of the face member 440, similar to the head 102 described above and shown in FIGS. 2-7. In this embodiment, the rear end 446 of the second leg 442 forms a generally straight edge, and the projecting portion 447 projects from the rear end 446 and has a trapezoid-shaped edge contour, rather than the curvilinear contour of the projecting portion 147 of the head 102 of FIGS. 2-7. Further, in the embodiment shown in FIGS. 17-21, the hosel 409 is integrally formed with the face member 440 as a single piece.

The body member 460 in the embodiment of FIGS. 17-21 extends from the top 416 to the sole 418 of the head 402, and extends from the face member 440 to the rear 426 of the head 402. The body member 460 includes a top portion 461 that is connected to the top end 443 of the first leg 441 of the face member 440 and forms at least a portion of the top side 416 of the head 402, and a bottom portion 462 that is connected to the rear end 446 of the second leg 442 of the face member 440 and forms at least part of the sole member 431 and the sole side 418 of the head 402. The bottom portion 462 of the body member 460 also includes an indent or indented portion 464 that is cooperatively dimensioned with the projecting portion 447 on the second leg 442 of the face member 440 such that the projecting portion 447 is received within the indent 464 when the face member 440 is connected to the body member 460. The body member 460 further includes side walls 463 extending rearwardly from the edges 413, 415, 417, 419 of the face 412 and connecting the top and bottom portions 461, 462. As shown in FIGS. 17-21, the body member 460 forms portions of the peripheral walls 433 of the head 402, in combination with portions of the face member 440. Additionally, the inner surfaces of the top portion 461, the bottom portion 462, and the side walls 463 of the body portion 460 define internal surfaces of the rear cavity 430.

In the embodiment shown in FIGS. 17-21, the face member 440 is welded to the body member 460 along a weld line 450 that extends continuously around the periphery of the face 412 and across the sole 418 at the juncture between the face member 440 and the body member 460. The weld line 450 includes one laterally-extending weld line segment 451 extending across the peripheral wall 433 on the top 416 of the head 402, another laterally-extending weld line segment 452 extending across the sole member 431 on the sole 418 of the head 402, and two vertically-extending weld line segments 453, 454 extending along the peripheral walls 433 on the heel 420 and toe 422 of the head 402 between the lateral weld lines 451, 452. The top lateral weld line 451 joins the top portion 461 of the body member 460 with the top end 443 of the first leg 441 of the face member 440. The bottom lateral weld line 452 joins the second leg 442 and the bottom end 444 of the first leg 441 of the face member 440 to the bottom portion 462 of the body member 460. The bottom lateral weld line 452 in this embodiment also has a jog portion 455 that follows the juncture line between the projecting portion 447 on the second leg 442 of the face member 440 and the indent 464 of the body member 460. The vertical weld lines 433 join the peripheral edges of the face member 440 to the side walls 463 of the body member 460. As shown in FIGS. 17-21, the weld line 450 extends over the entire juncture between the face member 440 and the body member 460 (e.g., through the entire thickness of the peripheral wall 433 and the sole member 431).

Figure 17:
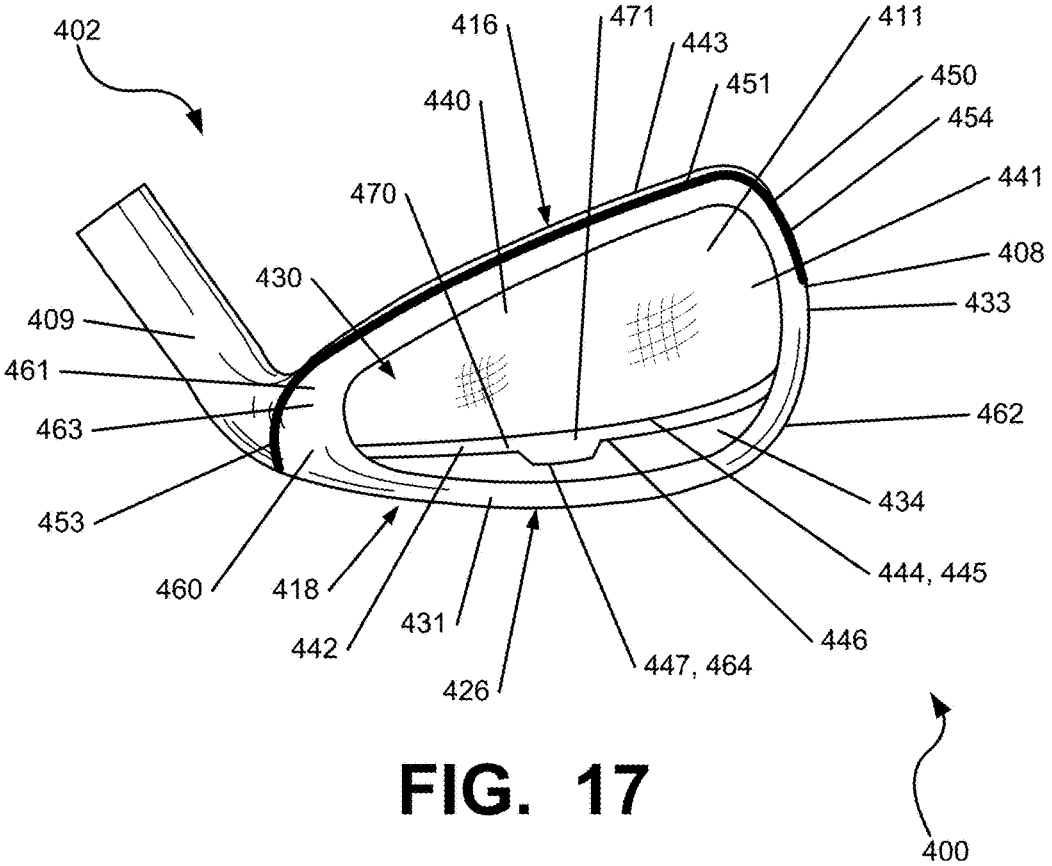
FIG. 17 is a rear view of a fourth illustrative embodiment of a head of a ball striking device.
Figure 18:
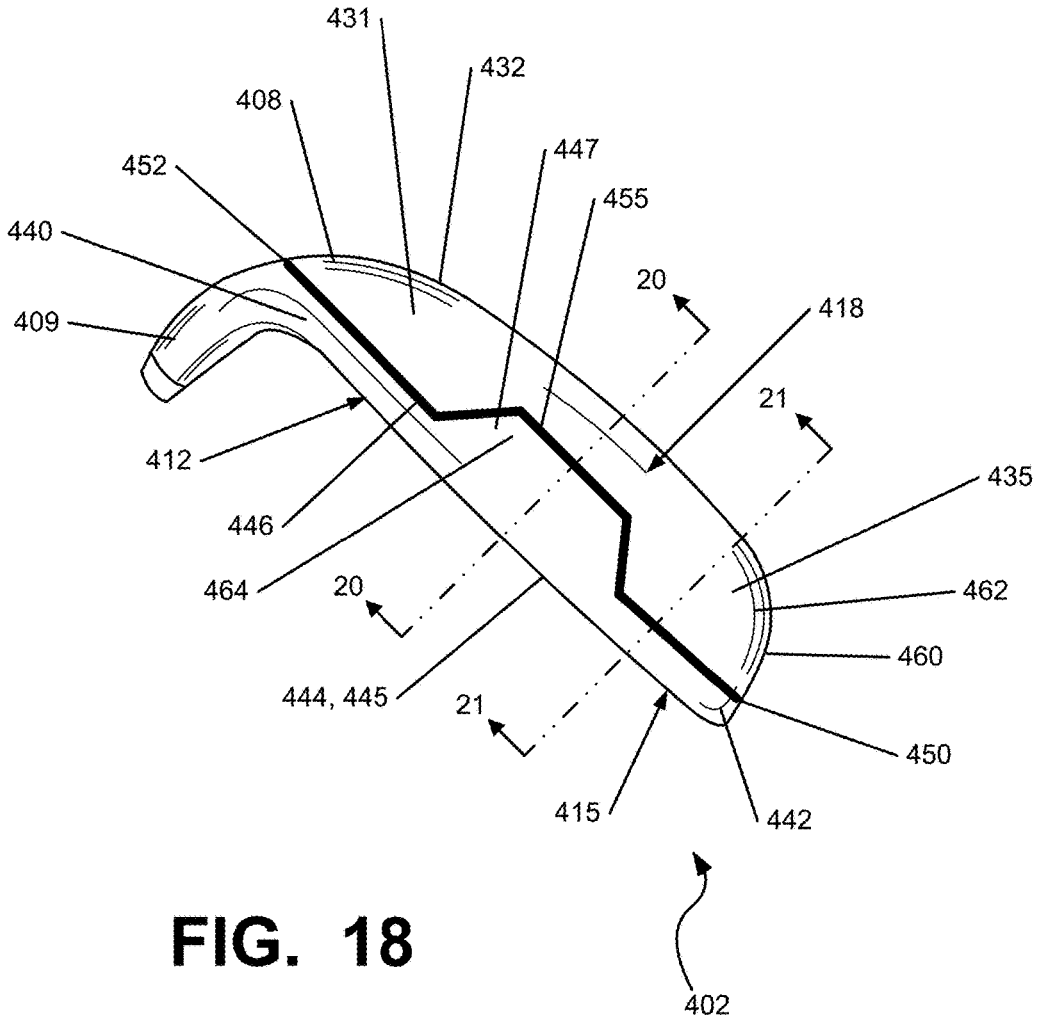
FIG. 18 is a bottom view of the head of FIG. 17.
Figure 19:
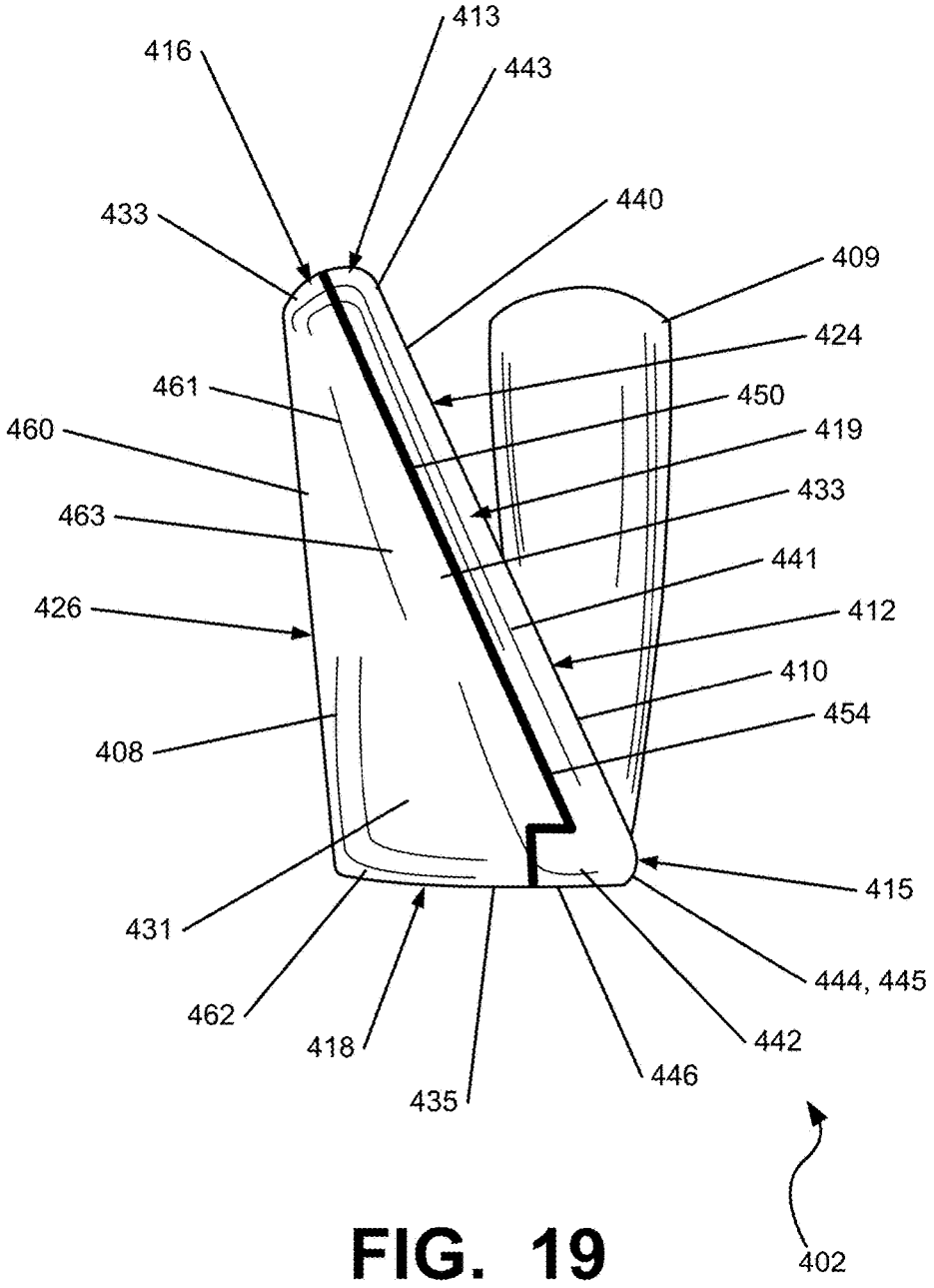
FIG. 19 is a side view of the head of FIG. 17.
Figure 20:
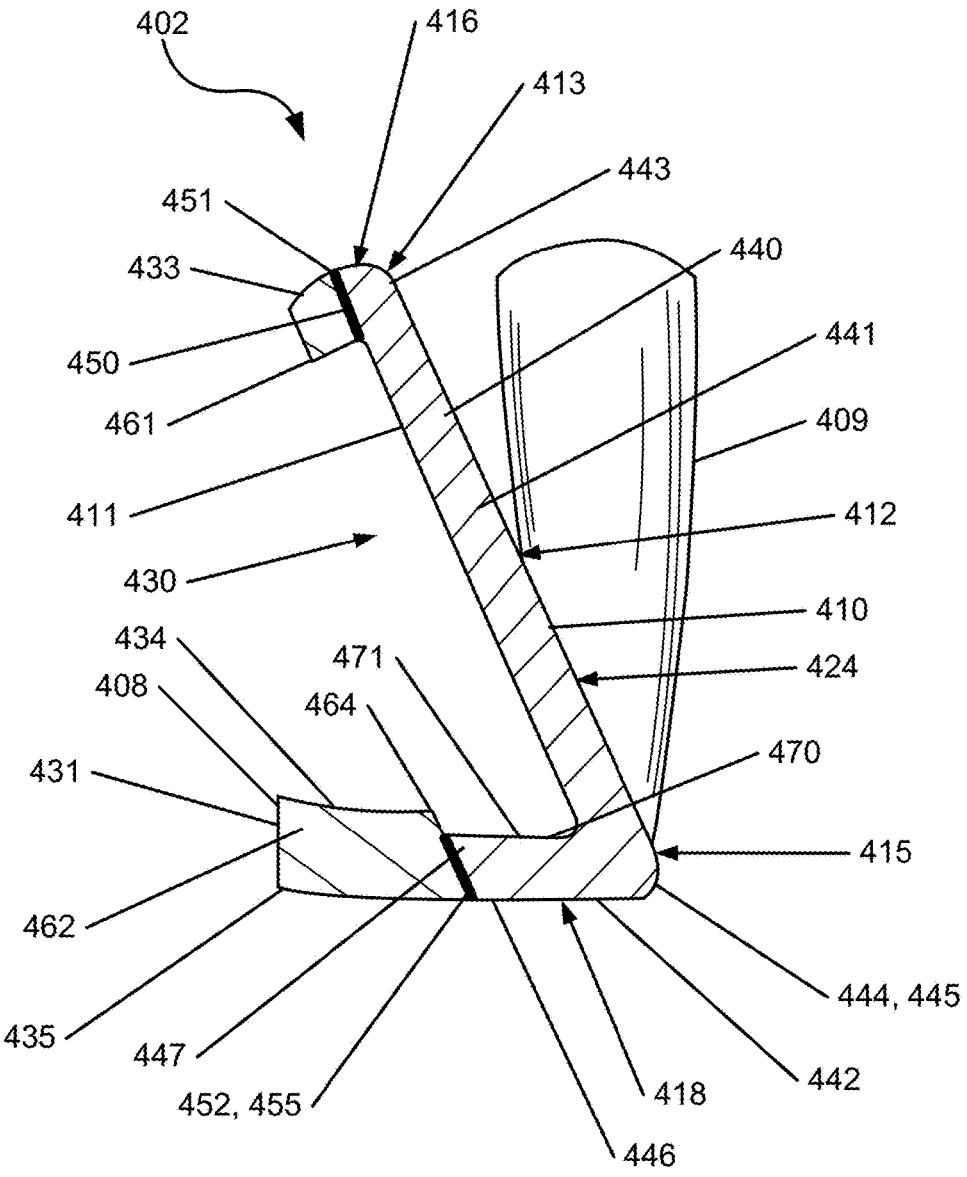
FIG. 20 is a cross-section view of the head of FIG. 17, taken along lines 20-20 of FIG. 18.
Figure 21:
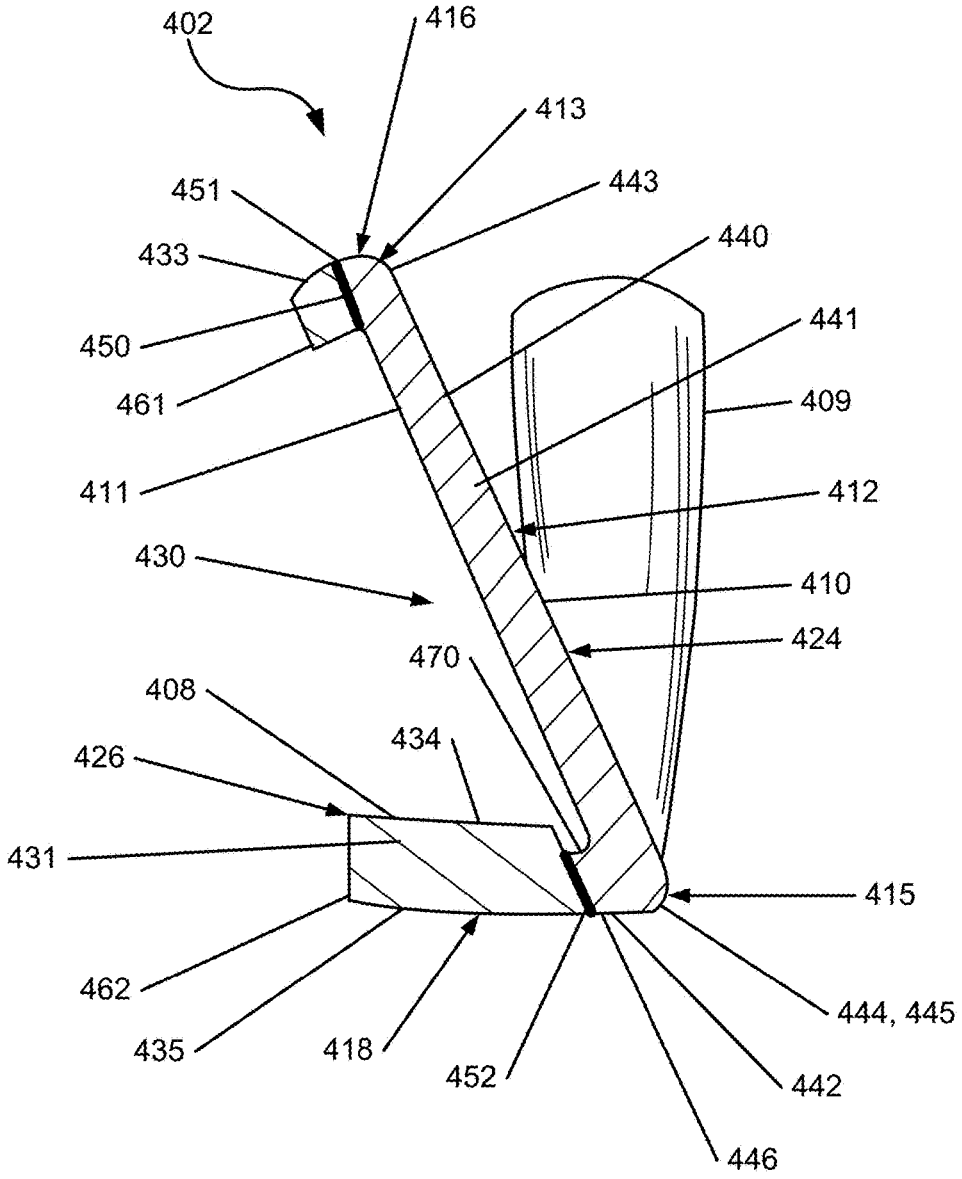
FIG. 21 is a cross-section view of the head of FIG. 17, taken along lines 21-21 of FIG. 18.
Figure 22:
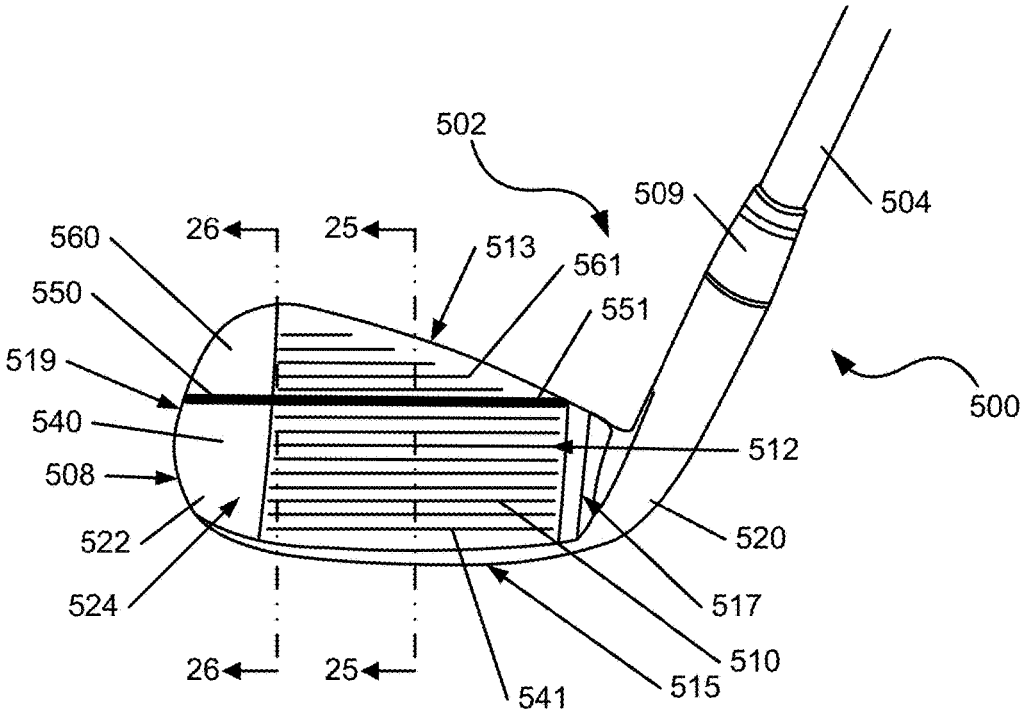
FIG. 22 is a front view of a fifth illustrative embodiment of a head of a ball striking device.

In this embodiment, the head 402 has a recessed channel 470 within the rear cavity 430 that runs laterally along the inner surface 434 of the sole member 431, along the juncture line between the inner surface 411 of the face 412 and the sole member 431. The channel 470 is defined by portions of the sole member 431 and the inner surface 411. As illustrated in FIGS. 20 and 21, the channel 470 is created by a difference in height between the bottom portion 462 of the body member 460 and the second leg 442 of the face member 440, and the channel 470 is recessed with respect to the top surface of the bottom portion 462 of the body member 460. Additionally, the channel 470 is defined between the bottom portion 462 of the body member 460, the second leg 442 of the face member 440, and the inner surface 411 of the face 412, and the channel 470 spaces the body member 460 from the inner surface 411 of the face 412. The channel 470 extends the entire width of the rear cavity 430, ending at the perimeter walls 433 at the heel 420 and toe 422 of the head 402, and, as illustrated in FIGS. 17, 20, and 21, the channel 470 includes a widened portion 471 proximate the centerline of the head 402, created by the combination of the projection 447 of the face member 440 and the indent 464 of the body member 460, similarly to the channel 170 of the head 102 in FIGS. 2-7.

FIGS. 22-26 illustrate a fifth embodiment of a ball-striking device 500 having a ball striking head 502 in the form of an iron-type golf club. Many features of the club 500 and the head 502 shown in FIGS. 22-26 are similar to features described above with respect to the club 100 and the head 102 in FIGS. 1-7. Such similar features are referenced in FIGS. 22-26 with similar reference numerals, using the "5xx" series of reference numerals. Accordingly, some features of the club 500 and the head 502 in FIGS. 22-26 that are similar to the features of the club 100 and head 102 in FIGS. 1-7 may not be re-described or may be described in lesser detail below, and some features of the club 500 and the head 502 may be described only with respect to the differences from the club 100 and the head 102 in FIGS. 1-7. As such, certain drawing figures may be unnecessary and duplicative of other drawing figures herein.

The head 502 of FIGS. 22-26 has a face 512, a body 508 connected to the face 512, and a hosel 509, and is formed of a face member 540 and a body member 560, similarly to the head 102 of FIGS. 1-7. The head 502 also has a rearwardly-extending sole member 531, as well as a rear cavity 530 defined by the sole member 531, the peripheral walls 533, and the inner surface 511 of the face 512. In this embodiment, the sole member 431 has a rear wall 532 partially defining the rear cavity 530. Additionally, the sole member 531 has heel and toe weighted portions 538 separated by a slot (not shown), and the outer surface 535 of the sole member 531 has beveled surfaces 537 between the keel 536 and the weighted portions 538, similar to the head 102 of FIGS. 1-7. In general, the structural features of the head 502 are otherwise similar to those of the head 102 in FIGS. 1-7.

Figure 23:
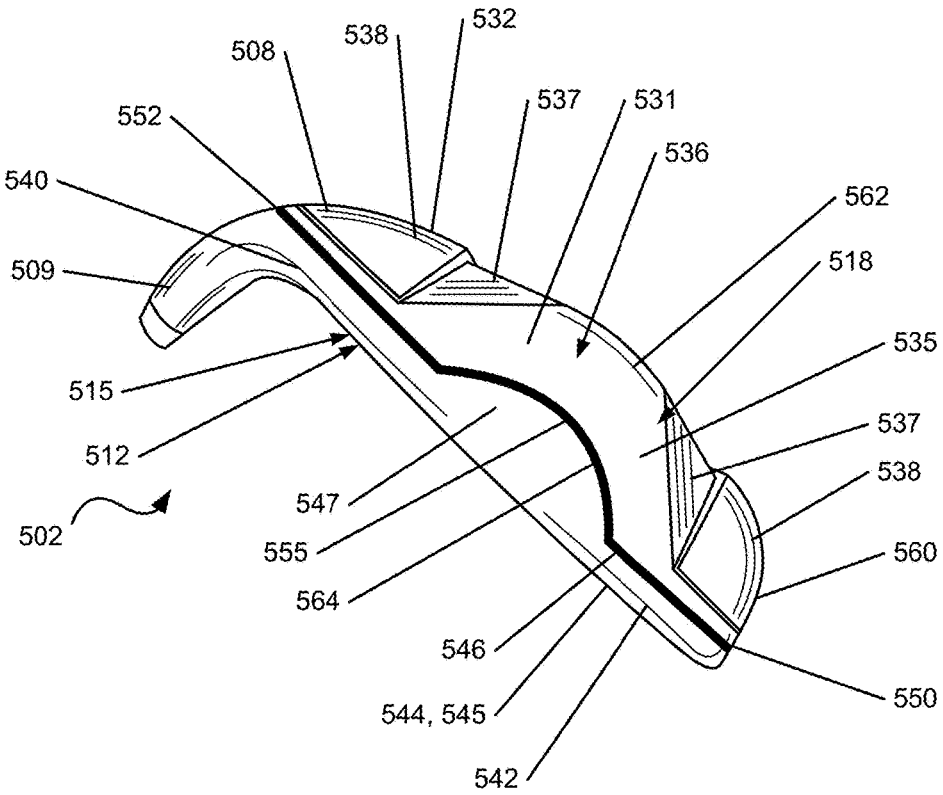
FIG. 23 is a bottom view of the head of FIG. 22.
Figure 24:
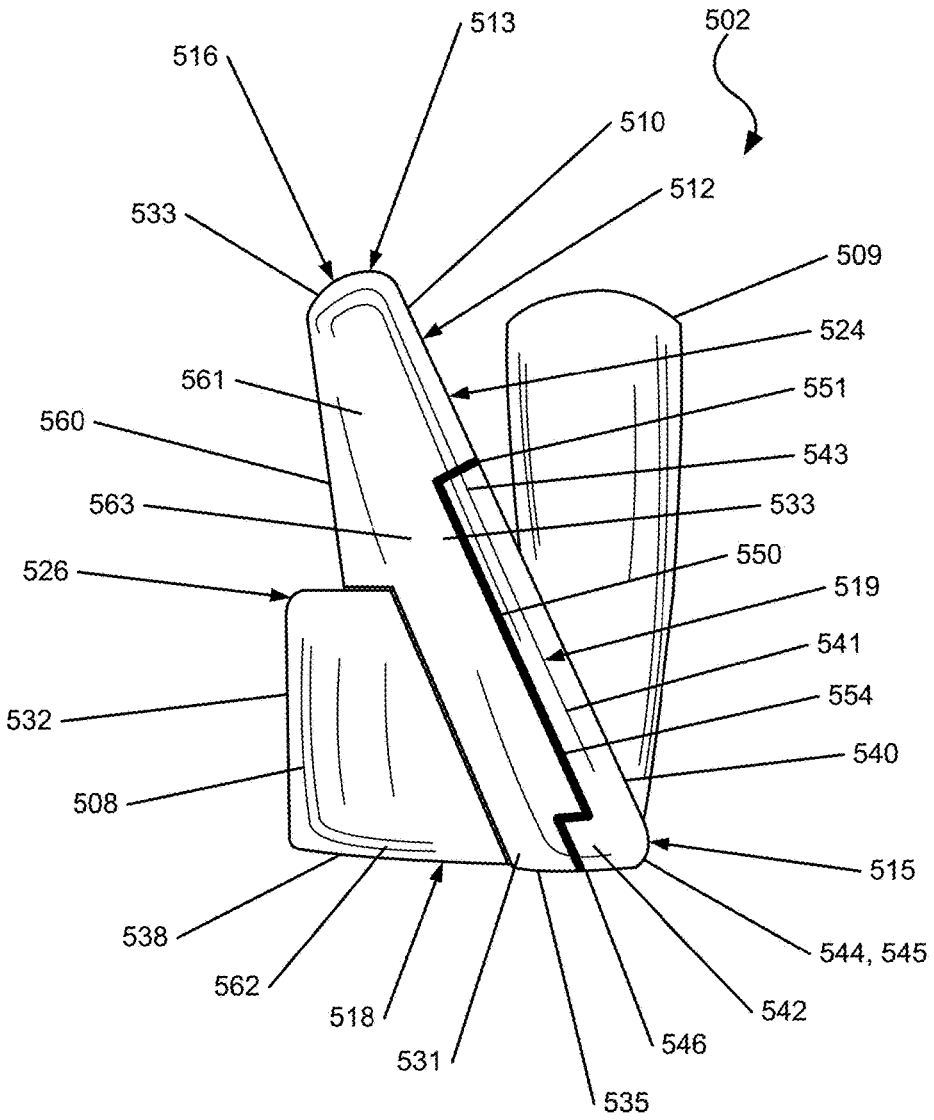
FIG. 24 is a side view of the head of FIG. 22.

In the embodiment of FIGS. 22-26, the head 502 is formed of a face member 540 and a body member 560 that have different configurations from the face members 140, 240, 340, 440 and the body members 160, 260, 360, 460 described above. In this embodiment, the face member 540 has a first leg 541 and a second leg 542, and has a generally L-shaped configuration when viewed in cross-section. The first leg 541 of the face member 540 forms a major portion of the face 512 of the head 502, including a major portion of ball striking surface 510. The first leg 541 also extends through the entire thickness of the face 512 from the ball striking surface 510 to the rear surface 511. The first leg 541 has a first or top end 543 that extends across the face 512 at a location above the lateral centerline of the face 512, and a second or bottom end 544 that extends to the bottom edge 515 of the face 512. In another embodiment, the top end 543 of the first leg 541 may not have a straight edge, and may be curved, or may have one or more projections and/or indentations. In a further embodiment, some or all of the top end 543 of the first leg 541 may be located below the lateral centerline of the face 512. Additionally, the first leg 541 forms portions of the peripheral walls 533 of the head 502, as shown in FIGS. 23-24. In this embodiment, the second leg 542 of the face member 540 forms part of the inner surface 534 and the outer surface 535 of the sole member 531, and thus, forms part of the sole 518 and defines a portion of the rear cavity 530. The second leg 542 has a first or front end 545 that is connected to the bottom end 544 of the first leg 541 at the bottom edge 515 of the face and extends rearwardly to a second or rear end 546 located rearward from the front end 545. As shown in FIGS. 22-26, the second leg 542 of the face member 540 has a projection or projecting portion 547 extending from the rear end 546 at or near the centerline of the face member 540, similar to the head 102 described above and shown in FIGS. 2-7. In this embodiment, the rear end 546 of the second leg 542 forms a generally straight edge, and the projecting portion 547 projects from the rear end 546 and has a curvilinear edge contour, similar to the projecting portion 147 of the head 102 of FIGS. 2-7. Further, in the embodiment shown in FIGS. 22-26, the hosel 509 is integrally formed with the face member 540 as a single piece.

The body member 560 in the embodiment of FIGS. 22-26 extends from the top 516 to the sole 518 of the head 502, and extends from the face member 540 to the rear 526 of the head 502. The body member 560 includes a top portion 561 that is connected to the top end 543 of the first leg 541 of the face member 540 and forms at least a portion of the top side 516 of the head 502 and a minor portion of the face 512, including a minor portion of the ball striking surface 510. The body member 560 also includes a bottom portion 562 that is connected to the rear end 546 of the second leg 542 of the face member 540 and forms at least part of the sole member 531 and the sole side 518 of the head 502. The bottom portion 562 of the body member 560 also includes an indent or indented portion 564 that is cooperatively dimensioned with the projecting portion 547 on the second leg 542 of the face member 540 such that the projecting portion 547 is received within the indent 564 when the face member 540 is connected to the body member 560. The body member 560 further includes side walls 563 extending rearwardly from the edges 513, 515, 517, 519 of the face 512 and connecting the top and bottom portions 561, 562, as well as the weighted portions 538 forming the rear wall 532. As shown in FIGS. 22-26, the body member 560 forms portions of the peripheral walls 533 of the head 502, in combination with portions of the face member 540. Additionally, the inner surfaces of the top portion 561, the bottom portion 562, the side walls 563, and the rear wall 532 of the body portion 560 define internal surfaces of the rear cavity 530.

In the embodiment shown in FIGS. 22-26, the face member 540 is welded to the body member 560 along a weld line 550 that extends continuously around the periphery of the face 512, across the sole 518, and laterally across the face 512 at the juncture between the face member 540 and the body member 560. The weld line 550 includes one laterally-extending weld line segment 551 extending laterally across the face 512 above the lateral centerline of the face 512, another laterally-extending weld line segment 552 extending across the sole member 531 on the sole 518 of the head 502, and two vertically-extending weld line segments 553, 554 extending along the peripheral walls 533 on the heel 520 and toe 522 of the head 502 between the lateral weld lines 551, 552. The top lateral weld line 551 joins the top portion 561 of the body member 560 with the top end 543 of the first leg 541 of the face member 540. The bottom lateral weld line 552 joins the second leg 542 and the bottom end 544 of the first leg 541 of the face member 540 to the bottom portion 562 of the body member 560. The bottom lateral weld line 552 in this embodiment also has a jog portion 555 that follows the juncture line between the projecting portion 547 on the second leg 542 of the face member 540 and the indent 564 of the body member 560. The vertical weld lines 533 join the peripheral edges of the face member 540 to the side walls 563 of the body member 560. As shown in FIGS. 22-26, the weld line 550 extends over the entire juncture between the face member 540 and the body member 560 (e.g., through the entire thickness of the face 512, the peripheral wall 533, and the sole member 531).

Figure 25:
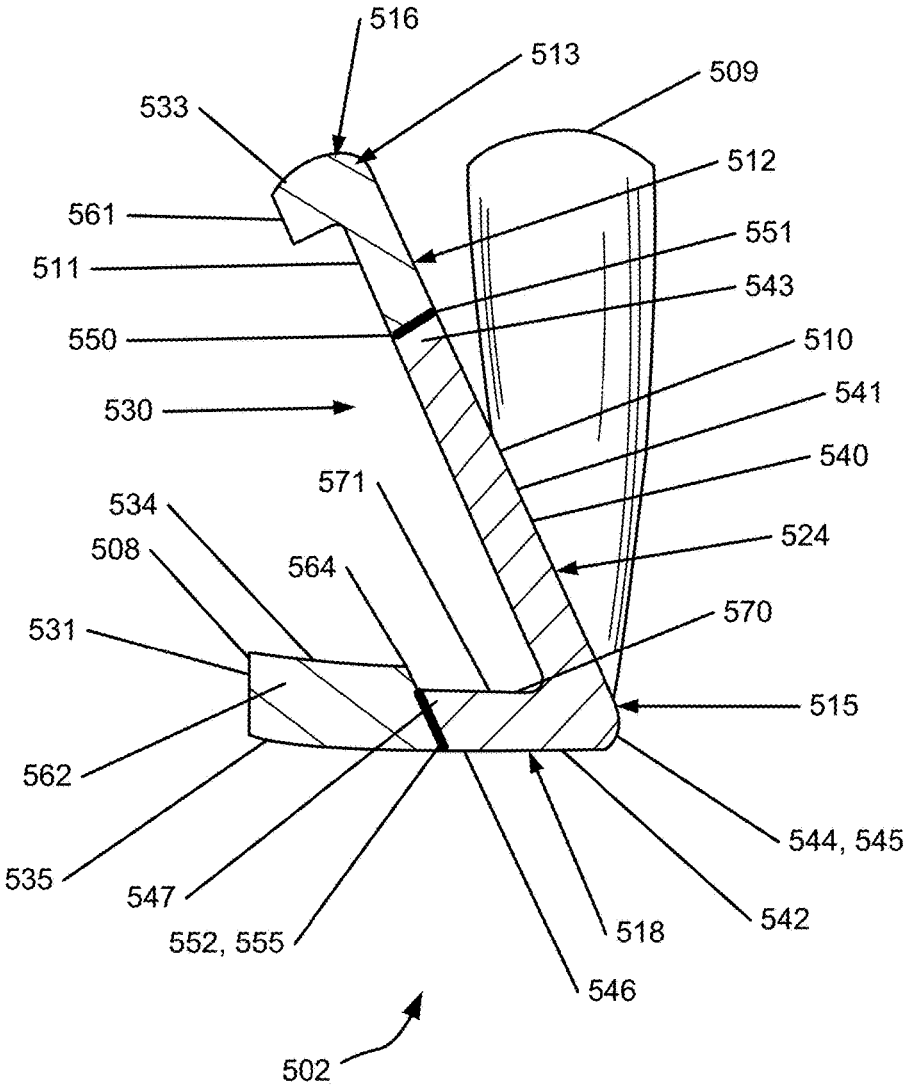
FIG. 25 is a cross-section view of the head of FIG. 22, taken along lines 25-25 of FIG. 22.
Figure 26:
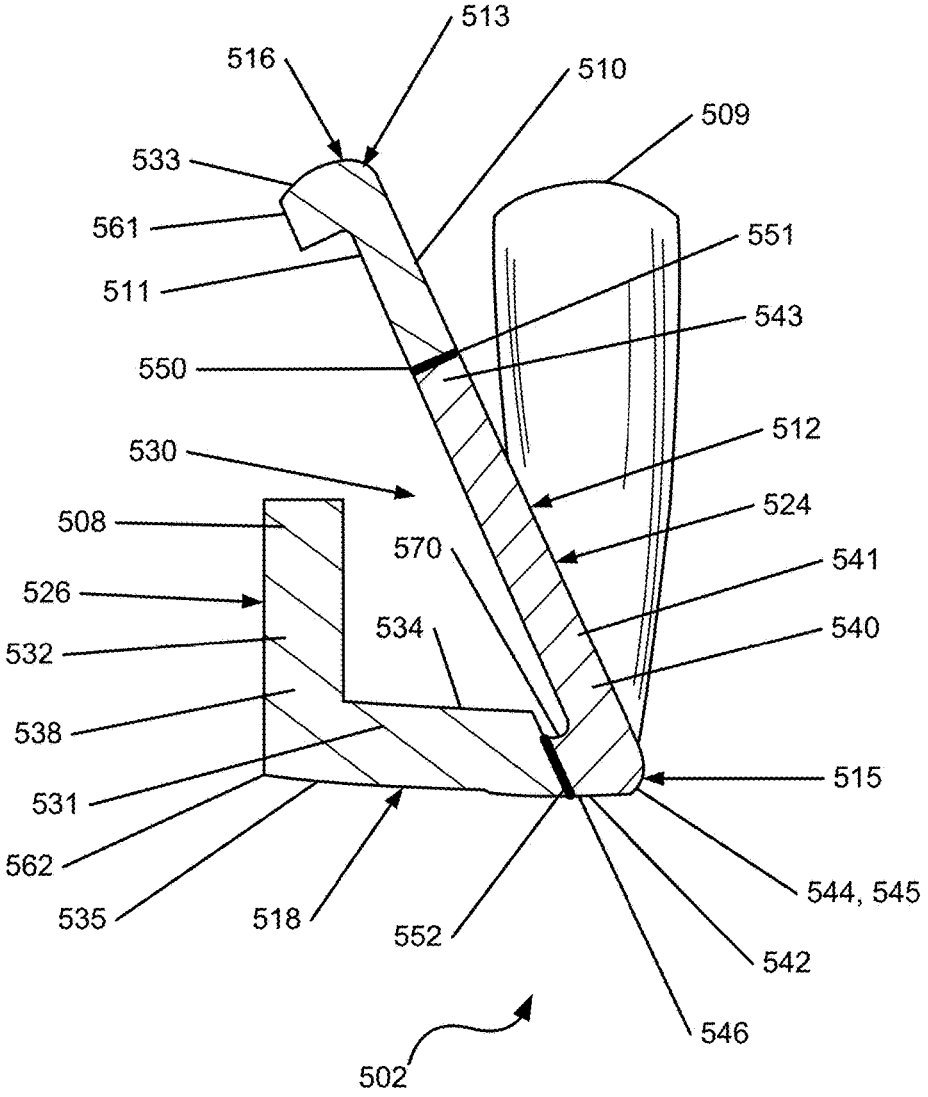
FIG. 26 is a cross-section view of the head of FIG. 22, taken along lines 26-26 of FIG. 22.
Figure 27:
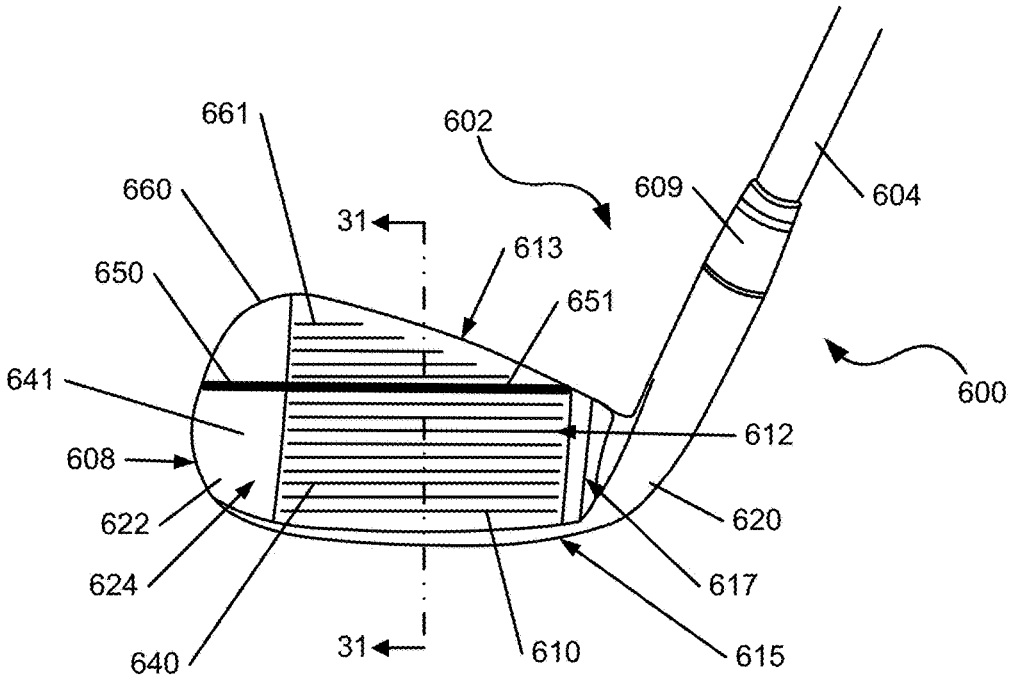
FIG. 27 is a front view of a sixth illustrative embodiment of a head of a ball striking device.

In this embodiment, the head 502 has a recessed channel 570 within the rear cavity 530 that runs laterally along the inner surface 534 of the sole member 531, along the juncture line between the inner surface 511 of the face 512 and the sole member 531. The channel 570 is defined by portions of the sole member 531 and the inner surface 511. As illustrated in FIGS. 25-26, the channel 570 is created by a difference in height between the bottom portion 562 of the body member 560 and the second leg 542 of the face member 540, and the channel 570 is recessed with respect to the top surface of the bottom portion 562 of the body member 560. Additionally, the channel 570 is defined between the bottom portion 562 of the body member 560, the second leg 542 of the face member 540, and the inner surface 511 of the face 512, and the channel 570 spaces the body member 560 from the inner surface 511 of the face 512. The channel 570 extends the entire width of the rear cavity 530, ending at the perimeter walls 533 at the heel 520 and toe 522 of the head 502, and, as illustrated in FIGS. 25 and 26, the channel 570 includes a widened portion 571 proximate the centerline of the head 502, created by the combination of the projection 547 of the face member 540 and the indent 564 of the body member 560, similarly to the channel 170 of the head 102 in FIGS. 2-7.

FIGS. 27-31 illustrate a fifth embodiment of a ball-striking device 600 having a ball striking head 602 in the form of an iron-type golf club. Many features of the club 600 and the head 602 shown in FIGS. 27-31 are similar to features described above with respect to the club 100 and the head 102 in FIGS. 1-7. Such similar features are referenced in FIGS. 27-31 with similar reference numerals, using the "6xx" series of reference numerals. Accordingly, some features of the club 600 and the head 602 in FIGS. 27-31 that are similar to the features of the club 100 and head 102 in FIGS. 1-7 may not be re-described or may be described in lesser detail below, and some features of the club 600 and the head 602 may be described only with respect to the differences from the club 100 and the head 102 in FIGS. 1-7. As such, certain drawing figures may be unnecessary and duplicative of other drawing figures herein.

The head 602 of FIGS. 27-31 has a face 612, a body 608 connected to the face 612, and a hosel 609, and is formed of a face member 640 and a body member 660, similarly to the head 102 of FIGS. 1-7. The head 602 also has a rearwardly-extending sole member 631, as well as a rear cavity 630 defined by the sole member 631, the peripheral walls 633, and the inner surface 611 of the face 612. In this embodiment, the sole member 631 has a rear wall 632 partially defining the rear cavity 630, similar to the heads 202, 302 of FIGS. 8-11 and 12-16. In general, the structural features of the head 602 are otherwise similar to those of the head 102 in FIGS. 1-7.

Figure 28:
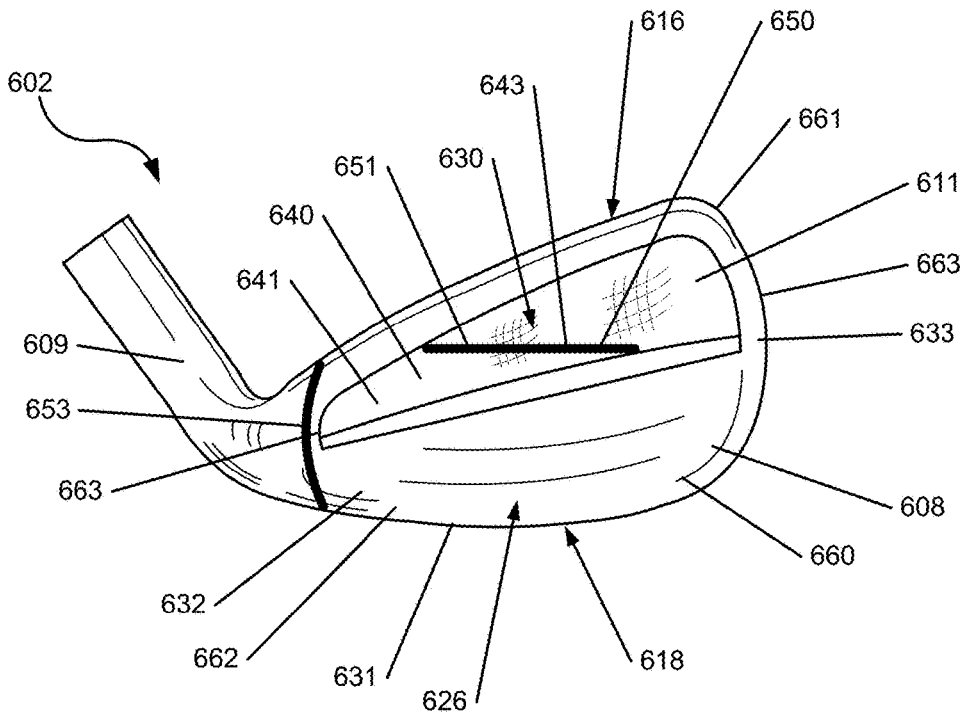
FIG. 28 is a rear view of the head of FIG. 27.
Figure 29:
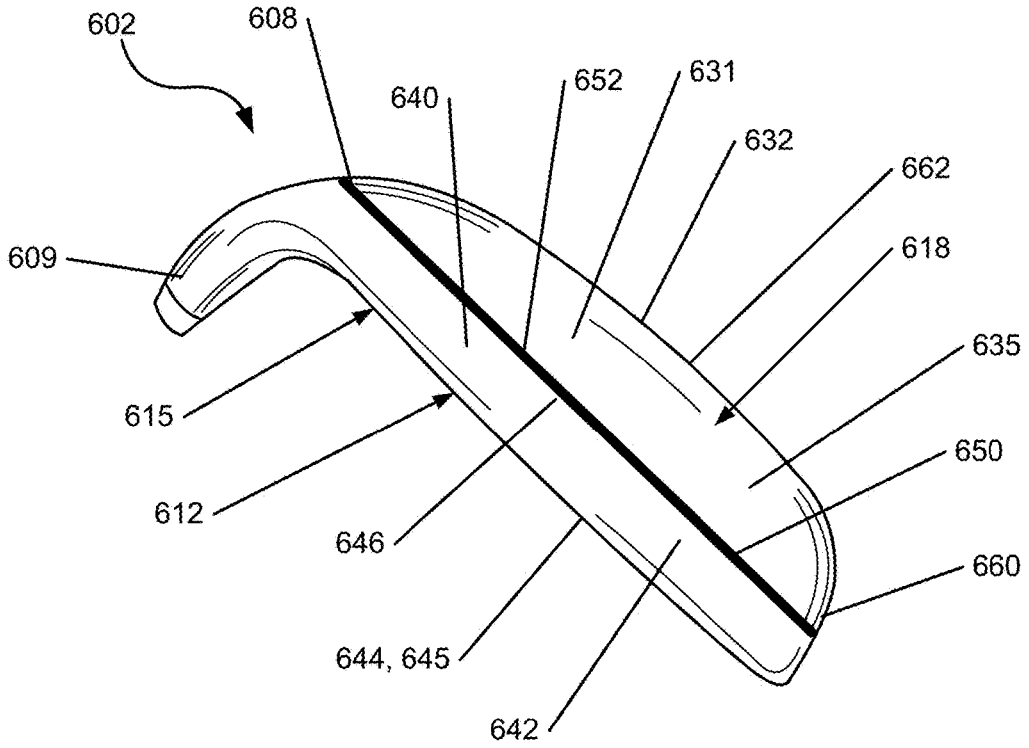
FIG. 29 is a bottom view of the head of FIG. 27.
Figure 30:
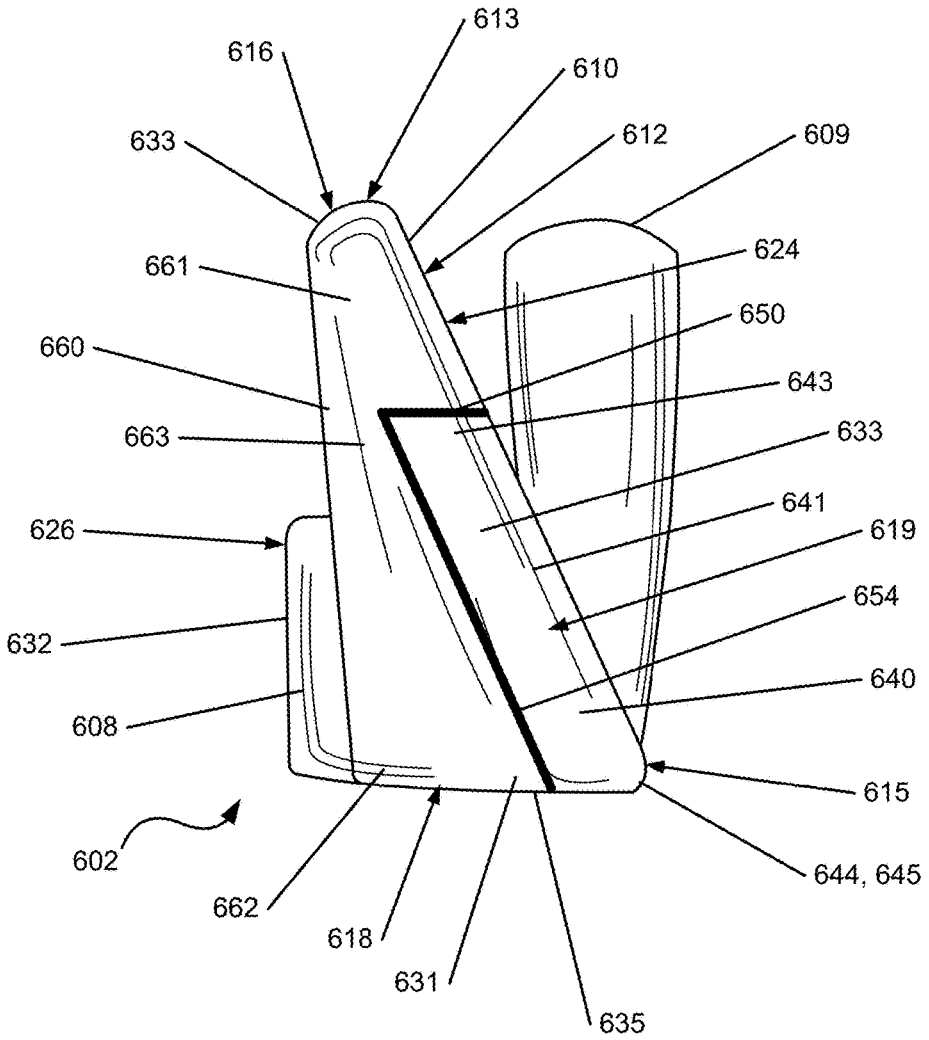
FIG. 30 is a side view of the head of FIG. 27.

In the embodiment of FIGS. 27-31, the head 602 is formed of a face member 640 and a body member 660 that have different configurations from the face members 140, 240, 340, 440, 540 and the body members 160, 260, 360, 460, 560 described above. In this embodiment, the face member 640 has a first leg 641 and a second leg 642, and has a generally L-shaped configuration when viewed in cross-section. The first leg 641 of the face member 640 forms a major portion of the face 612 of the head 602, including a major portion of the ball striking surface 610. The first leg 641 also extends through the entire thickness of the face 612 from the ball striking surface 610 to the rear surface 611. The first leg 641 has a first or top end 643 that extends across the face 612 at a location above the lateral centerline of the face 612 and a second or bottom end 644 that extends to the bottom edge 615 of the face 612, similar to the face member 640 in FIGS. 22-26. Additionally, the first leg 641 forms portions of the peripheral walls 633 of the head 602, as shown in FIGS. 28-30. In this embodiment, the second leg 642 of the face member 640 forms part of the inner surface 634 and the outer surface 635 of the sole member 631, and thus, forms part of the sole 618 and defines a portion of the rear cavity 630. The second leg 642 has a first or front end 645 that is connected to the bottom end 644 of the first leg 641 at the bottom edge 615 of the face and extends rearwardly to a second or rear end 646 located rearward from the front end 645. As shown in FIGS. 27-31, the second leg 642 of the face member 640 forms a generally straight edge across the entire width of the sole 618. Further, in the embodiment shown in FIGS. 27-31, the hosel 609 is integrally formed with the face member 640 as a single piece.

The face member 640 also includes third and fourth legs 648, 649 that extend rearwardly from the vertical side edges of the face member 640 (the heel and toe edges 617, 619 of the face 612), as shown in FIGS. 28 and 30. The third and fourth legs 648, 649 extend farther rearward than the inner surface 611 of the face 612, and form portions of the peripheral edges 633 of the head 602. The third leg 648 and the fourth leg 649 each have a rear end 656 and 657, respectively, located rearward of the side edges of the face member 640, and each of the rear ends 656, 657 is formed as a generally straight edge.

The body member 660 in the embodiment of FIGS. 27-31 extends from the top 616 to the sole 618 of the head 602, and extends from the face member 640 to the rear 626 of the head 602. The body member 660 includes a top portion 661 that is connected to the top end 643 of the first leg 641 of the face member 640 and forms at least a portion of the top side 616 of the head 602 and a minor portion of the face 612, including a minor portion of the ball striking surface 610. The body member 660 also includes a bottom portion 662 that is connected to the rear end 646 of the second leg 642 of the face member 640 and forms at least part of the sole member 631 and the sole side 618 of the head 602. The body member 660 further includes side walls 663 connected to the third and fourth legs 648, 649 of the face member 612 and extending between the top and bottom portions 661, 662. As shown in FIGS. 27-31, the body member 660 forms portions of the peripheral walls 633 of the head 602, in combination with the third and fourth legs 648, 649 of the face member 640. Additionally, the inner surfaces of the top portion 661, the bottom portion 662, the side walls 663, and the rear wall 632 of the body portion 660 define internal surfaces of the rear cavity 630.

In the embodiment shown in FIGS. 27-31, the face member 640 is welded to the body member 660 along a weld line 650 that extends continuously around the periphery of the face 612, across the sole 618, and laterally across the face 612 at the juncture between the face member 640 and the body member 660. The weld line 650 includes one laterally-extending weld line segment 651 extending laterally across the face 612 above the lateral centerline of the face 612, another laterally-extending weld line segment 652 extending across the sole member 631 on the sole 618 of the head 602, and two vertically-extending weld line segments 653, 654 extending along the peripheral walls 633 on the heel 620 and toe 622 of the head 602 between the lateral weld lines 651, 652. The top lateral weld line 651 joins the top portion 661 of the body member 660 with the top end 643 of the first leg 641 of the face member 640. The bottom lateral weld line 652 joins the second leg 642 and the bottom end 644 of the first leg 641 of the face member 640 to the bottom portion 662 of the body member 660. The vertical weld lines 633 join the third and fourth legs 648, 649 of the face member 640 to the side walls 663 of the body member 660. As shown in FIGS. 27-31, the weld line 650 extends over the entire juncture between the face member 640 and the body member 660 (e.g., through the entire thickness of the face 612, the peripheral wall 633, and the sole member 631).

Figure 31:
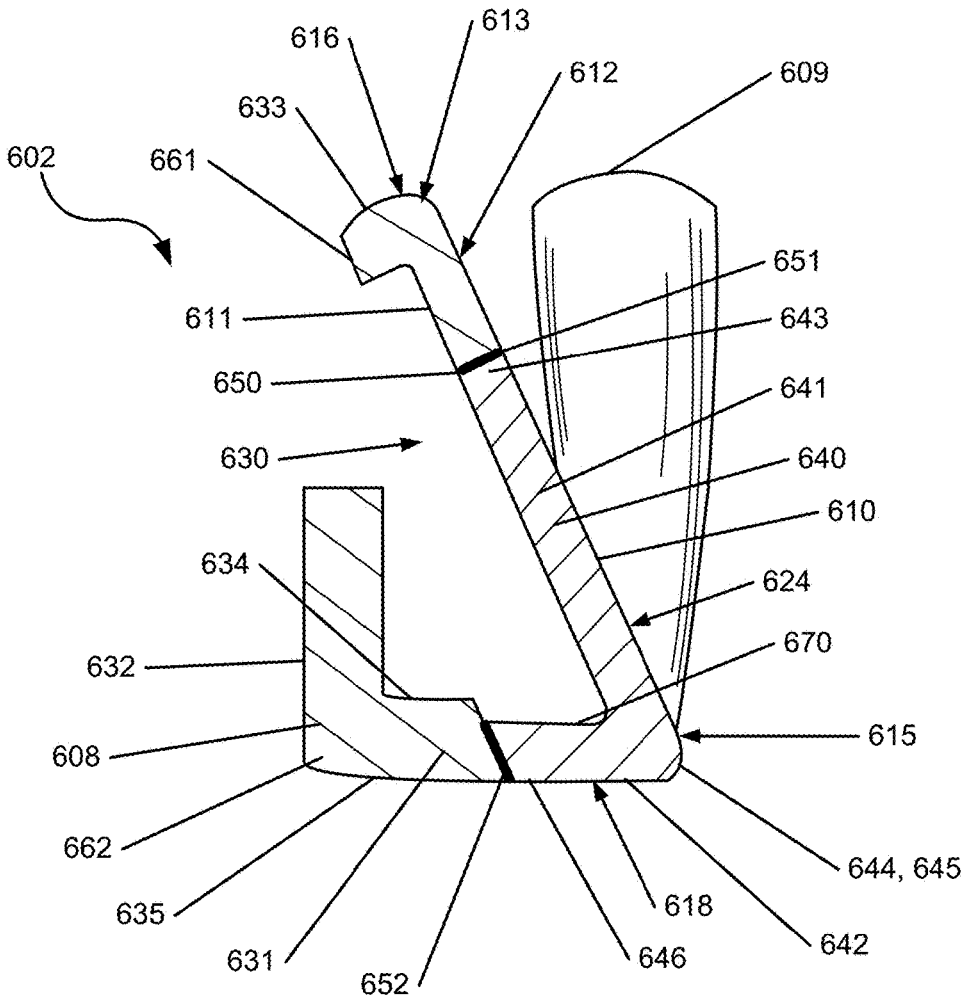
FIG. 31 is a cross-section view of the head of FIG. 27, taken along lines 31-31 of FIG. 27.

In this embodiment, the head 602 has a recessed channel 670 within the rear cavity 630 that runs laterally along the inner surface 634 of the sole member 631, along the juncture line between the inner surface 611 of the face 612 and the sole member 631. The channel 670 is defined by portions of the sole member 631 and the inner surface 611. As illustrated in FIG. 31, the channel 670 is created by a difference in height between the bottom portion 662 of the body member 660 and the second leg 642 of the face member 640, and the channel 670 is recessed with respect to the top surface of the bottom portion 662 of the body member 660. Additionally, the channel 670 is defined between the bottom portion 662 of the body member 660, the second leg 642 of the face member 640, and the inner surface 611 of the face 612, and the channel 670 spaces the body member 660 from the inner surface 611 of the face 612. The channel 670 extends the entire width of the rear cavity 630, ending at the perimeter walls 633 at the heel 620 and toe 622 of the head 602, and has a substantially constant front-to-rear length.

The configurations of the face member 140 and the body member 160 of the head 102 in FIGS. 2-7 can be used to adjust the position the area of highest COR response (i.e. the "hot zone" or "sweet spot") of the face 112, such as by directionally enlarging the area, as illustrated in FIG. 2. Area 180 represents the area of highest COR response in a typical iron-type golf club head, and area 182 represents the area of highest COR response in a head 102 according to this embodiment. As shown in FIG. 2, the area 182 of highest COR response is directionally enlarged toward the bottom edge 115 of the face 112 in this embodiment. An iron-type golf club such as the club 100 illustrated in FIGS. 1-2, can benefit from this enlarged area 182 of highest COR response, as iron-type club heads often impact the ball in play below the center of the face 112. In another embodiment, the configuration may adjust the position of the area 182 of highest COR response toward the bottom edge of the face 112 by shifting the area 182, rather than by directionally enlarging the area 182. The other embodiments of ball striking devices 200, 300, 400, 500, 600 and ball striking heads 202, 302, 402, 502, 602 also provide configurations that adjust the positions of the respective areas of highest COR response, similarly to the embodiment of FIGS. 1-7. These configurations and embodiments may be advantageous in other ball striking devices, including other types of golf clubs, as well.

Several different embodiments have been described above, including the iron-type golf clubs 100, 200, 300, 400, 500, 600 and heads 102, 202, 302, 402, 502, 602. It is understood that any of the features of these various embodiments may be combined and/or interchanged. For example, as described above, various different combinations of club heads 102, et seq. with differently configured face members 140, et seq. and body members 160, et seq. may be used, including the configurations described herein, variations or combinations of such configurations, or other configurations. In further embodiments, at least some of the features described herein can be used in connection with other configurations of iron-type clubs, or with other non-iron-type clubs.

Heads 102, et seq. incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. A set of golf clubs may also be created, containing at least one golf club 100 as described herein. For example, several different iron-type clubs 100 according to aspects of the invention may be assembled as a set of irons. Manufacturing the head 102, et seq. may also include welding or otherwise integrally joining a face member 140, et seq. to a body member 160, et seq. to create the head 102, et seq. In other embodiments, different types of ball striking devices can be manufactured according to the principles described herein. Additionally, the head 102, et seq., golf club 100, et seq., or other ball striking device may be fitted or customized for a person by custom fitting, which may include selection of a head 102, et seq., and/or one of various configurations of face members 140, et seq. and body members 160, et seq. having a particular characteristic that is suited for a particular golfer. Further, a single face member 140, et seq. may be used in many different club head configurations, such as by attaching one of a plurality of differently configured body members 160, et seq. to the face member 140, et seq. For example, a single face member 140, et seq. for an iron-type head may be cooperatively dimensioned with a plurality of different body members 160, et seq., including body members, 160, et seq. configured as cavity-back, partial cavity-back, and blade-type iron, as well as other configurations. Likewise, a single body member 160, et seq. may be cooperatively dimensioned with, and configured for connection to, a plurality of different face members 140, et seq. Various other different configurations are possible, and various other club heads may be designed for various performance characteristics.

The ball striking devices and heads therefor as described herein provide many benefits and advantages over existing products. For example, as described above, the embodiments described herein have areas of highest COR response that are adjusted in position closer to the bottom edge of the face, relative to a club head without such a configuration. This can be beneficial for iron-type golf clubs, as well as other types of golf clubs and ball striking devices. Additionally, the two-piece, integrally joined construction is capable of being quickly and efficiently manufactured in a variety of different configurations. For example, iron-type golf clubs can be manufactured in cavity-back, partial cavity-back, or blade-type configurations, as well as other configurations. A single face member may be used in any of these configurations, by connecting one of a plurality of differently-configured body members to the face member. This also increases the customizability of the head. Further benefits and advantages are readily recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An iron-type golf club head comprising:

a face having a ball-striking surface configured for striking a ball;

a body connected to the face, the body having a sole surface configured to confront a playing surface in use, wherein the head is formed in part by a face member having a first leg forming at least a major portion of the face and a second leg extending rearwardly from a bottom end of the first leg and forming at least a portion of the sole surface, and the head is further formed in part by a body member connected to the face member, the body member having a top portion forming at least a portion of a top side of the body and a bottom portion forming at least a portion of the sole surface, and wherein a juncture is formed between the face member and the body member, the juncture extending continuously across a top side of the body, between a top end of the first leg and the top portion of the body member, downward along a heel side and a toe side of the body, and across the sole surface of the body, between a rear end of the second leg and the bottom portion of the body member;

a connection structure connecting the face member to the body member to form the head, wherein the connection structure comprises a plurality of weld line segments along the juncture, wherein the plurality of weld line segments are intermittent and extend over less than the entire juncture; and a projection extending rearward from the second leg, the projection forming a portion of the sole surface, and wherein the body member has an indent cooperatively dimensioned with the projection, the indent receiving the projection when the body member is connected to the face member, such that the juncture between the face member and the body member has a rearward jog formed by the projection.

2. The head of claim 1, wherein the plurality of weld line segments comprise a vertical heel weld line segment extending along the juncture on the heel side of the body and a vertical toe weld line segment extending along the juncture on the toe side of the body.

3. The head of claim 2, wherein the plurality of weld line segments further comprise a horizontal top weld line segment extending along the juncture on the top side of the body.

4. The head of claim 2, wherein the plurality of weld line segments further comprise a horizontal bottom weld line segment extending along the juncture along the sole surface of the body, between the rear end of the second leg and the bottom portion of the body member.

5. The head of claim 1, wherein the plurality of weld line segments extend through only a portion of a thickness of the juncture.

6. The head of claim 1, wherein the plurality of weld line segments further comprise a horizontal bottom weld line segment extending along the juncture along the sole surface of the body, and along the jog in the juncture, between the rear end of the second leg and the bottom portion of the body member.

7. The head of claim 1, wherein the body further comprises a sole member having the sole surface thereon and a rear cavity defined at least partially by the sole member and a rear surface of the face, wherein a bottom surface of the rear cavity is defined by portions of the body member and the face member.

8. An iron-type golf club, comprising the head of claim 1 and a shaft connected to the head.

9. An iron-type golf club head comprising:

a face having a substantially flat ball-striking surface at a front of the golf club head configured for striking a ball;

a body connected to the face, the body having a sole surface configured to confront a playing surface in use, wherein the head is formed in part by a face member having a first leg forming at least a major portion of the face and a second leg extending rearwardly from a bottom end of the first leg and forming at least a portion of the sole surface, and the head is further formed in part by a body member connected to the face member, the body member having a top portion forming at least a portion of a top side of the body, a heel portion forming at least a portion of a heel side of the body and a heel section of the ball-striking surface, a toe portion forming at least a portion of a toe side of the body and a toe section of the ball-striking surface, and a bottom portion forming at least a portion of the sole surface, and wherein a juncture is formed between the face member and the body member, the juncture extending across a top side of the body, between a top end of the first leg and the top portion of the body member, downward across the heel section and the toe section of the face, and across the sole surface of the body, between a rear end of the second leg and the bottom portion of the body member; and a connection structure connecting the face member to the body member to form the head, wherein the connection structure comprises a plurality of weld line segments along the juncture, wherein the plurality of weld line segments are intermittent and extend over less than the entire juncture.

10. The head of claim 9, wherein the plurality of weld line segments comprise a horizontal top weld line segment extending along the juncture on the top side of the body and a horizontal bottom weld line segment extending along the juncture along the sole surface of the body, between the rear end of the second leg and the bottom portion of the body member.

11. The head of claim 10, wherein the plurality of weld line segments further comprise a vertical heel weld line segment extending along the juncture across the heel section of the face and a vertical toe weld line segment extending along the juncture across the toe section of the face.

12. The head of claim 9, wherein the plurality of weld line segments extend through only a portion of a thickness of the juncture.

13. The head of claim 9, wherein the rear end of the second leg of the face member comprises a projection extending rearward from the second leg, the projection forming a portion of the sole surface, and wherein the body member has an indent cooperatively dimensioned with the projection, the indent receiving the projection when the body member is connected to the face member, such that the juncture between the face member and the body member has a rearward jog formed by the projection.

14. The head of claim 9, wherein the body further comprises a sole member having the sole surface thereon and a rear cavity defined at least partially by the sole member and a rear surface of the face, wherein a bottom surface of the rear cavity is defined by portions of the body member and the face member.

15. An iron-type golf club, comprising the head of claim 9 and a shaft connected to the head.

16. An iron-type golf club head comprising:

a face having a substantially flat ball-striking surface at a front of the golf club head configured for striking a ball;

a body connected to the face, the body having a sole surface configured to confront a playing surface in use, wherein the head is formed in part by a face member having a first leg forming at least a major portion of the face and a second leg extending rearwardly from a bottom end of the first leg and forming at least a portion of the sole surface, and the head is further formed in part by a body member connected to the face member, the body member having a top portion forming at least a portion of a top side of the body and a top section of the ball-striking surface, and a bottom portion forming at least a portion of the sole surface, and wherein a juncture is formed between the face member and the body member, the juncture extending across the top section of the ball-striking surface, between a top end of the first leg and the top portion of the body member, downward along a heel side and a toe side of the body, and across the sole surface of the body, between a rear end of the second leg and the bottom portion of the body member; and a connection structure connecting the face member to the body member to form the head, wherein the connection structure comprises a plurality of weld line segments along the juncture, wherein the plurality of weld line segments are intermittent and extend over less than the entire juncture.

17. The head of claim 16, wherein the plurality of weld line segments comprise a vertical heel weld line segment extending along the juncture on the heel side of the body and a vertical toe weld line segment extending along the juncture on the toe side of the body.

18. The head of claim 17, wherein the plurality of weld line segments further comprise a horizontal top weld line segment extending along the juncture across the top section of the face, between the top end of the first leg and the top portion of the body member.

19. The head of claim 17, wherein the plurality of weld line segments further comprise a horizontal bottom weld line segment extending along the juncture along the sole surface of the body, between the rear end of the second leg and the bottom portion of the body member.

20. The head of claim 16, wherein the plurality of weld line segments extend through only a portion of a thickness of the juncture.

21. The head of claim 16, wherein the rear end of the second leg of the face member comprises a projection extending rearward from the second leg, the projection forming a portion of the sole surface, and wherein the body member has an indent cooperatively dimensioned with the projection, the indent receiving the projection when the body member is connected to the face member, such that the juncture between the face member and the body member has a rearward jog formed by the projection.

22. The head of claim 16, wherein the body further comprises a sole member having the sole surface thereon and a rear cavity defined at least partially by the sole member and a rear surface of the face, wherein a bottom surface of the rear cavity is defined by portions of the body member and the face member.

23. An iron-type golf club, comprising the head of claim 16 and a shaft connected to the head.

* * * * *